US008043097B2

(12) United States Patent
Ngo et al.

(10) Patent No.: US 8,043,097 B2
(45) Date of Patent: Oct. 25, 2011

(54) LOW PROFILE POWER CONNECTOR HAVING HIGH CURRENT DENSITY

(75) Inventors: Hung Viet Ngo, Harrisburg, PA (US); Scott A. Kleinle, Mechanicsburg, PA (US); Timothy W. Houtz, Etters, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/687,237

(22) Filed: Jan. 14, 2010

(65) Prior Publication Data

US 2010/0184339 A1 Jul. 22, 2010

Related U.S. Application Data

(60) Provisional application No. 61/205,276, filed on Jan. 16, 2009.

(51) Int. Cl.
*H01R 12/00* (2006.01)

(52) U.S. Cl. ..... 439/79; 439/744; 439/206

(58) Field of Classification Search ..... 439/79, 439/206, 485, 733.1, 744, 883
See application file for complete search history.

(56) References Cited

U.S. PATENT DOCUMENTS

| | | | |
|---|---|---|---|
| 2,762,026 | A | 9/1956 | Knohl |
| 4,425,015 | A | 1/1984 | Rizzo |
| 4,464,832 | A | 8/1984 | Asick et al. |
| 4,582,386 | A | 4/1986 | Martens |
| 4,687,267 | A | 8/1987 | Header et al. |
| 4,734,041 | A | 3/1988 | Bruchmann et al. |
| 4,753,609 | A | 6/1988 | Pfeffer et al. |
| 4,762,500 | A | 8/1988 | Dola et al. |
| 4,975,084 | A | 12/1990 | Fedder et al. |
| 5,052,953 | A | 10/1991 | Weber |
| 5,064,391 | A | 11/1991 | Buchter |
| 5,147,228 | A | 9/1992 | Miller et al. |
| 5,919,049 | A | 7/1999 | Petersen et al. |
| 6,203,328 | B1 | 3/2001 | Ortega et al. |
| 6,210,240 | B1 | 4/2001 | Comerci et al. |
| 6,290,514 | B1 | 9/2001 | McHugh et al. |
| 6,575,774 | B2 | 6/2003 | Ling et al. |
| 6,648,657 | B1 | 11/2003 | Korsunsky et al. |
| 6,652,322 | B2 | 11/2003 | Ito et al. |
| 6,746,281 | B1 | 6/2004 | Zhang |
| 6,780,018 | B1 | 8/2004 | Shipe |
| 6,832,933 | B2 | 12/2004 | Bu et al. |
| 6,848,950 | B2 | 2/2005 | Allison et al. |
| 6,863,572 | B1 | 3/2005 | Yi et al. |
| 7,011,548 | B2 | 3/2006 | Bogiel et al. |
| 7,104,812 | B1 | 9/2006 | Bogiel et al. |
| RE39,380 | E | 11/2006 | Davis |
| 7,354,282 | B2 | 4/2008 | Margulis et al. |
| 7,488,222 | B2 | 2/2009 | Clark et al. |
| 7,520,760 | B2 | 4/2009 | Margulis et al. |
| 7,597,573 | B2 | 10/2009 | Defibaugh et al. |

(Continued)

OTHER PUBLICATIONS

Tyco Electronics Power Connectors & Interconnection Systems, Introduction to High Current Card Edge Connectors, Catalog 1773096, Revised Jul. 2007.

(Continued)

*Primary Examiner* — Khiem Nguyen
(74) *Attorney, Agent, or Firm* — Woodcock Washburn LLP

(57) ABSTRACT

A receptacle power connector is provided having first and second rows of electrical power contacts retained in a connector housing. The connector housing has a low profile, and the power contacts are arranged in rows that each achieves a current density of about 120 Amps/linear inch (2.54 cm).

30 Claims, 18 Drawing Sheets

U.S. PATENT DOCUMENTS

| | | | |
|---|---|---|---|
| 2002/0042225 | A1 | 4/2002 | Crane, Jr. et al. |
| 2002/0168901 | A1 | 11/2002 | Choumach |
| 2003/0224628 | A1 | 12/2003 | Korsunsky et al. |
| 2006/0003620 | A1 | 1/2006 | Daily et al. |
| 2006/0228948 | A1 | 10/2006 | Swain et al. |
| 2007/0004291 | A1 | 1/2007 | Bogiel et al. |
| 2007/0293084 | A1 | 12/2007 | Ngo |
| 2009/0142953 | A1 | 6/2009 | Patel et al. |
| 2009/0298303 | A1 | 12/2009 | Vrenna et al. |

OTHER PUBLICATIONS

Tyco Electronics Releases New Card Edge Power Connector, Tyco Electronics Corp., Release dated Feb. 16, 2009, Harrisburg, Pennsylvania.

http://www.molex.com/molex/products/family?channel=products&chanName=family&pageTitle=Introduction&key=extreme_poweredge, EXTreme PowerEdge™: EXTreme PowerEdge™ connectors with signal contacts for combined high-power and signal card edge or busy bar tab applications, printed Feb. 25, 2010, 1 page.

http://www.molex.com/molex/products/family?channel=products&chanName=family&pageTitle=Introduction&key=extreme_lphpower, EXTreme LPHPower™ Low-Profile Hybrid Power Connector: High-current, low-profile EXTreme LPHPPower™ connector extends mounting flexibility to backplane or midplane mating applications, printed Feb. 25, 2010, 1 page.

T
L
A
31
92
96
58B
54B
95
50B
37
60
56B
58B
62
94
34

35B
96
95
94
107
33B
37
34
33A
33
35A
35
36

58C
52C
96
54C
95
79C
76C
78C
58C
129A
94
125
121
104
129B
37

98
129A
58C
80C
56C
50C
102
127
79C
97
98
54B
52B
100
56B
54B
99
95
58B

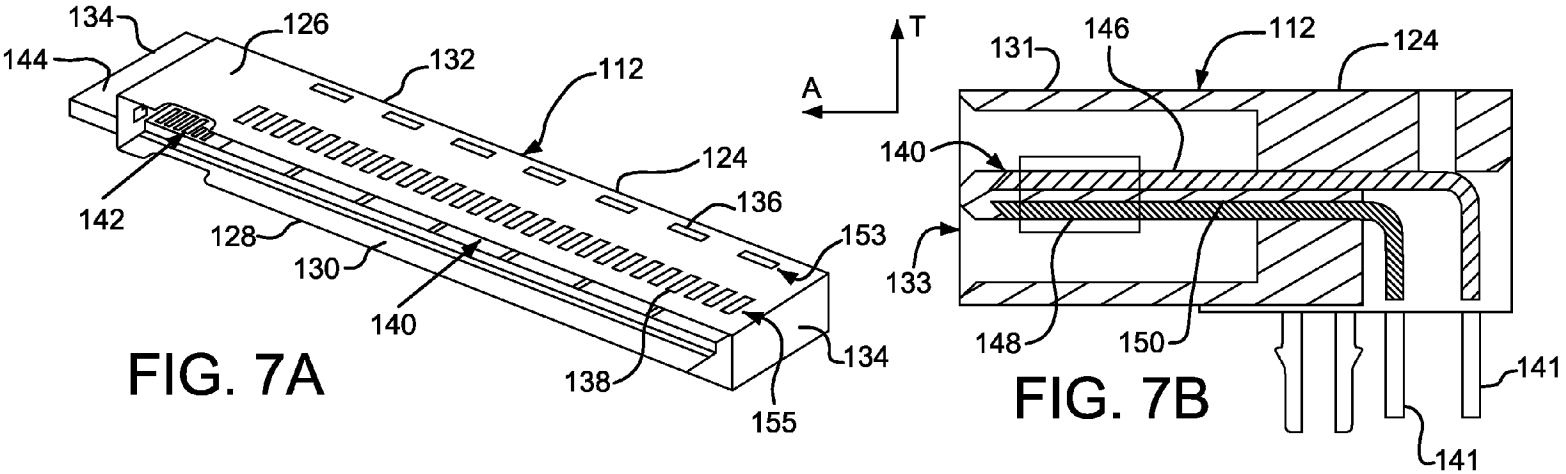
FIG. 7B
FIG. 7A
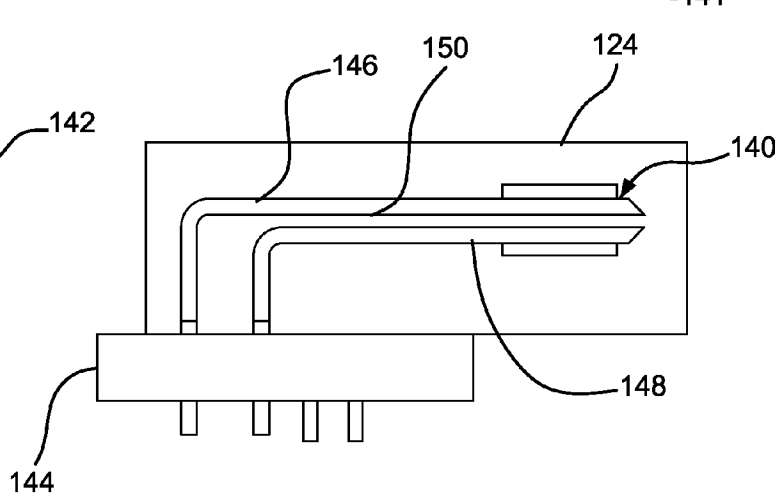
FIG. 7D
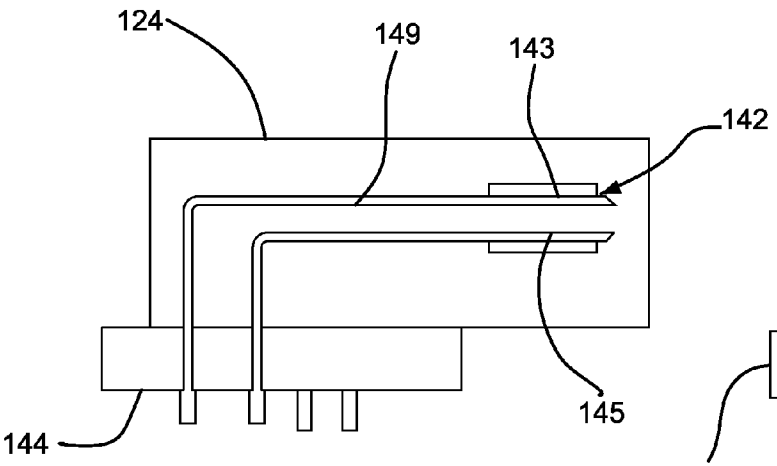
FIG. 7C

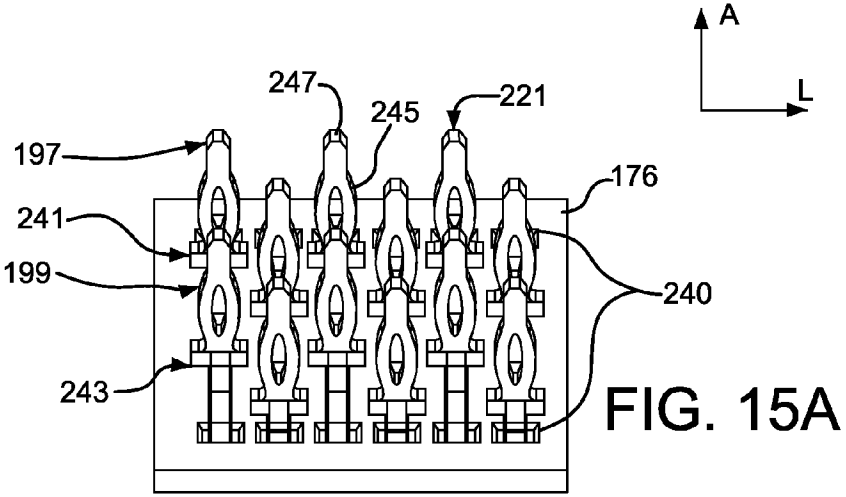
FIG. 15A
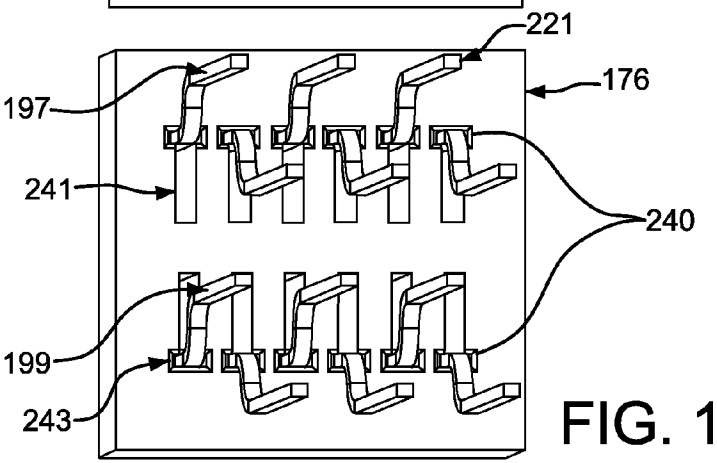
FIG. 15B
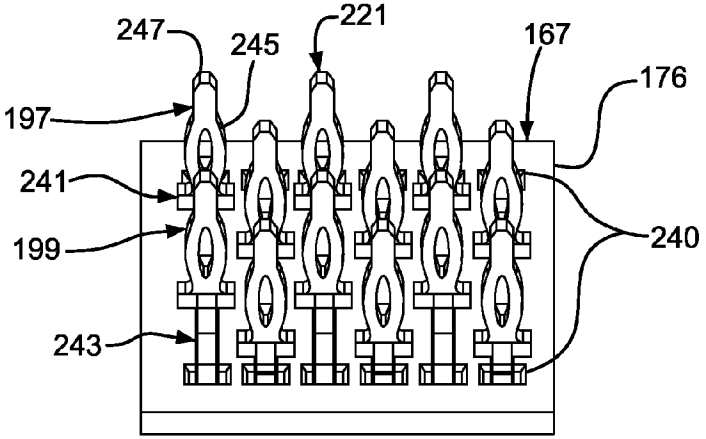
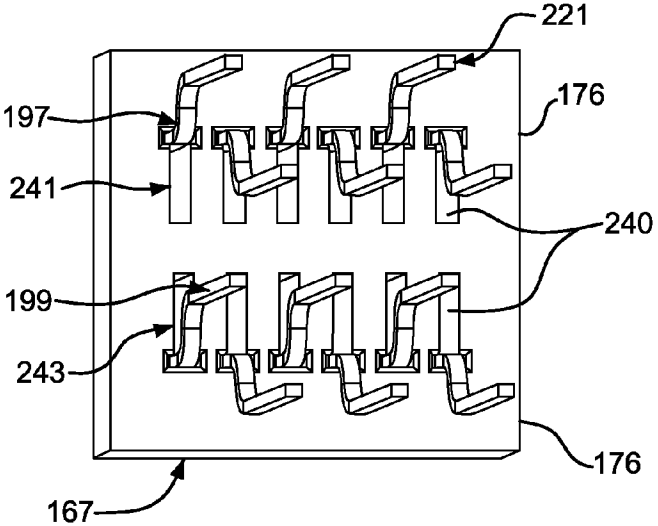

LOW PROFILE POWER CONNECTOR HAVING HIGH CURRENT DENSITY

CROSS REFERENCE TO RELATED APPLICATIONS

This application claims the benefit of U.S. Patent Application Ser. No. 61/205,276, filed Jan. 16, 2009, the disclosure of which is hereby incorporated by reference as if set forth in its entirety herein.

TECHNICAL FIELD

The present disclosure relates generally to electrical connectors, and more specifically relates to an electrical connector for transmitting electrical power.

BACKGROUND

Referring to FIGS. 1A and 1B, a conventional power connector 20 is illustrated having a power connector housing 22 and top and bottom electrical contacts 24 and 26 arranged in top and bottom rows 28 and 30, respectively. The electrical contacts 24 and 26 have mounting ends 28 configured to attach to a substrate, and mating ends 29 formed from single beams that are configured to receive contacts from another electrical device. The power connector 20 defines a front side 21 juxtaposed with the mating ends 29 of the contacts 24 and 26, and a rear side 23 that receives the contacts 24 and 26. The contacts 24 of row 28, and the contacts 26 of row 30 are each are individually installed into the rear of the connector housing 22, such that the contacts along each row are spaced at a pitch, for instance, of 2.54 mm (or 0.100 in).

SUMMARY

In accordance with one aspect, an electrical power connector includes a connector housing having a front end that defines a mating interface, wherein the mating interface further defines a slot. A first row of first power contacts is supported by the housing, the first power contacts each defining a first mating end and an opposing first mounting end. A second row of second power contacts is supported by the housing at a location spaced from the first row of power contacts, the second power contacts each defining a second mating end and an opposing second mounting end. Each of the first power contacts comprises a horizontal panel and a panel engagement member on each respective horizontal panel. The panel engagement member engages a complementary housing engagement member on the connector housing to retain the first power contacts with respect to the connector housing. Each complementary housing engagement member is located in a respective ventilation window defined by the connector housing.

BRIEF DESCRIPTION OF THE DRAWINGS

The foregoing summary, as well as the following detailed description of example embodiments, are better understood when read in conjunction with the appended diagrammatic drawings. For the purpose of illustrating the invention, the drawings show embodiments that are presently preferred. The invention is not limited, however, to the specific instrumentalities disclosed in the drawings.

FIG. 7A is a perspective view of the electrical right-angle header connector illustrated in FIGS. 6A-C having a plurality of signal blades and power blades;

FIG. 7B is a sectional elevation view of the electrical right-angle header connector illustrated in FIG. 7A;

FIG. 7C is a sectional elevation view of the electrical right-angle header connector illustrated in FIG. 7A showing a pair of signal blades;

FIG. 7D is a sectional elevation view of the electrical right-angle header connector illustrated in FIG. 7A showing a pair of power blades;

FIG. 15A is a perspective view of mounting ends of electrical signal contacts installed in a vertical receptacle connector housing, configured as press-fit tails;

FIG. 15B is a perspective view of mounting ends of electrical signal contacts installed in a vertical receptacle connector housing, configured as solder tails.

DETAILED DESCRIPTION

Figure 2A:
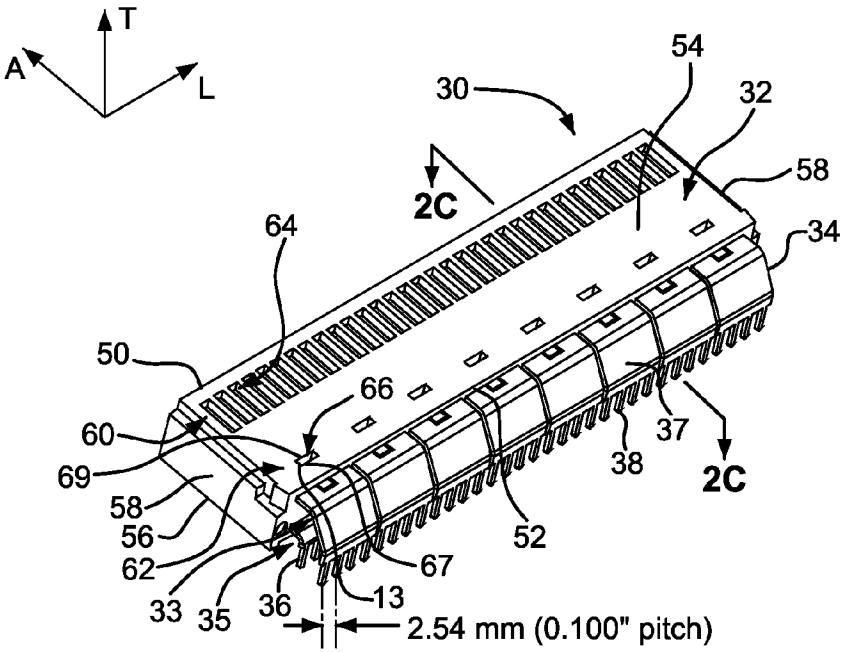
FIG. 2A is a perspective view of an electrical right-angle receptacle connector having top and bottom rows of power contacts constructed in accordance with an example embodiment.
Figure 2B:
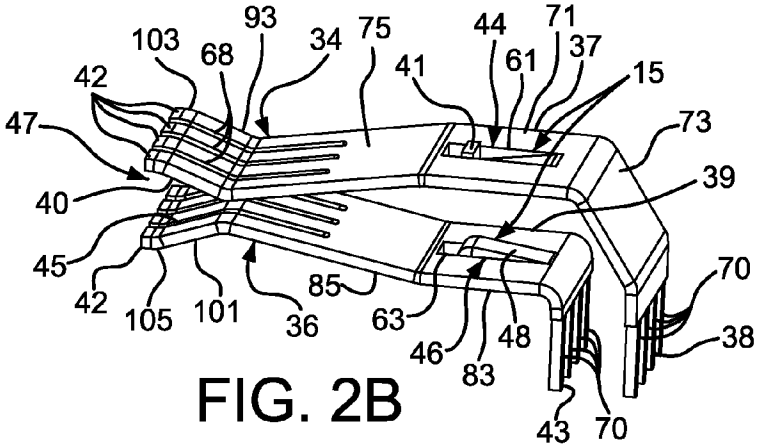
FIG. 2B is a perspective view of top and bottom power contacts illustrated in FIG. 2A.
Figure 2C:
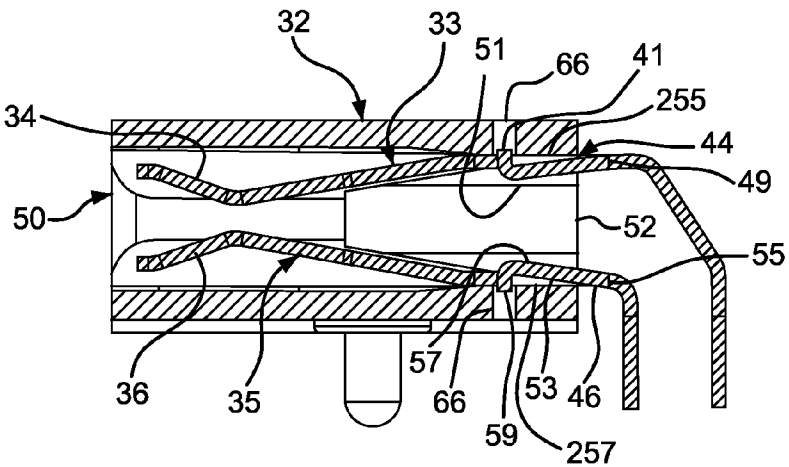
FIG. 2C is a sectional view of the electrical connector illustrated in FIG. 2A taken along line 2C-2C.

Referring to FIGS. 2A-C, an electrical right-angle receptacle power connector 30 includes a connector housing 32 that is illustrated as extending horizontally along a longitudinal direction "L" that defines a length of the housing 32, and a lateral direction "A" that defines a width of the housing 32, and vertically along a transverse direction "T" that defines a height of the housing 32. The housing 32 is elongate along the longitudinal direction L. Unless otherwise specified herein, the terms "lateral," "longitudinal," and "transverse" are used to describe the orthogonal directional components of connector 30 and its components. The terms "inner" and "outer," and "above" and "below" and derivatives thereof as used with respect to a specified directional component of a given apparatus are intended to refer to directions along the directional component toward and away from the geometric center of the apparatus, unless otherwise indicated.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the desired orientation of the connector 30. Accordingly, the terms "vertical" and "horizontal" are used to describe the connector 30 as illustrated merely for the purposes of clarity and convenience, it being appreciated that these orientations may change during use.

With continuing reference to FIGS. 2A-C, the connector housing 32 supports first and second power receptacle contacts 34 and 36, respectively. The contacts 34 and 36, and all contacts described herein, can be made from any suitable conductive material unless otherwise specified, and the housing 32, and all connector housings described herein, can be made from any suitable dielectric material unless otherwise specified.

The first power contacts 34 are supported by the housing 32 in a first longitudinal row 33 of first power contacts, and the second power contacts 36 are supported by the housing 32 in a second bottom longitudinal row 35 of second power contacts. The first longitudinal row 33 may be disposed above the second longitudinal row 35 in the illustrated embodiment, and can be referred to as a "top" or "upper" row, while the second longitudinal row 35 can be referred to as a "bottom" or "lower" row. Thus, the first power contacts 34 can be referred to as "top" contacts, while the second power contacts 36 can be referred to as "bottom" contacts.

Referring to FIGS. 2B-C, each of the first power contacts 34 or the second power contacts 36 includes a respective main body portion 37 and 39, a respective mounting end 38 and 43 connected to one end of the body portion 37 and 39 and configured to attach to a substrate, such as a printed circuit board (or PCB), and a respective mating end 40 and 45 connected to an opposing end of the body portion 37 and 39. The mounting ends 38 and 43 define laterally separated split mounting tails 70 that extend down from the contact bodies 37 and 39. The mounting ends 38 and 43 can be provided as solder tails (and can have include a solder ball connected thereto), eye-of-the-needle press-fit pins, or any alternative configuration suitable for attaching to a PCB. The first and second power contacts can be made from an eighty or ninety percent conductive material.

The upper contact body 37 includes a horizontal panel 71, and an angled spacer panel 73 extending laterally rearward and transversely down from the rear end of the horizontal panel 71. The mounting end 38 extends transversely down from the rear end of the angled spacer panel 73. The upper contact body 37 further includes an angled front panel 75 extending laterally forward and transversely down from the front end of the horizontal panel 71. The lower contact body 39 includes a horizontal panel 83, and the mounting end 43 extends down from the horizontal panel 83. The horizontal panels 71 and 83 are aligned, such that the angled spacer panel causes the mounting end 83 of the upper contact 34 to be disposed rearward with respect to the mounting end 43 of the lower contact 36. The lower contact body 39 further defines an angled front panel 85 extending laterally forward and transversely up from the front end of the horizontal panel 83.

The front panels 75 and 85 extend from their respective horizontal panels 71 and 83 at the same, but opposite angles such that they flare toward each other in a forward direction along the contact bodies 37 and 39, but do not touch each other. A mating panel 93 extends laterally forward and transversely up from the front end of the front panel 75, and a mating panel 101 extends laterally forward and transversely down from the front end of the front panel 85, such that the mating panels 93 and 101 flare away from each other in a forward direction along the respective contact bodies 37 and 39. Mating terminal ends 103 and 105 extend horizontally forward from the mating panels 93 and 101, respectively, though the mating terminal ends 103 and 105 could curve upward or downward as desired.

The mating ends 40 and 45 of each contact 34 and 36 include a plurality of longitudinally spaced gaps 68 that extend transversely through the respective mating terminal ends 103 and 105, the mating panels 93 and 101, and a front end of the front panels 78 and 85. The gaps 68 define split blades 42 of the mating ends 40 and 45. In the illustrated embodiment, the mating ends 40 include four split blades 42, however any number of split blades greater than or equal to one (for instance at least two, at least three, or more than four) are contemplated. In the illustrated embodiment, the split blades 42 of the upper mating end 40 are aligned with the split blades 42 of the lower mating end 45. A contact-receiving space 47 is disposed between the mating ends 40 and 45 of vertically aligned contacts 34 and 36, and is configured to receive an electrical contact therebetween (for instance a blade contact) of a mating electrical device, such as a power PCB card edge, an electrical header connector, or the like. Accordingly, the contacts 34 and 36 can be referred to as receptacle contacts. The contact-receiving 47 space necks down to a location between the interface of the front panel 75 and mating panel 93, and the front panel 85 and the mating panel 101. Because the contact-receiving space 57 extends in a direction (e.g., lateral) that is perpendicular with respect to the mounting ends 38 and 43 (e.g., transverse), the contacts 34 and 36 can be referred to as right-angle contacts.

The main body portion 37 and 39 of each contact 34 and 36 includes corresponding engagement members 15 illustrated as including latches 44 and 46, respectively, disposed in corresponding pockets 61 and 63 formed through the body portions 37 and 39. The latch 44 of the top contact 34 includes a laterally extending flexible arm 46 having a proximal end 49 connected to the main body portion 37, and a free distal end 51 that carries an upwardly projecting tab 41. Similarly, the latch 46 of the bottom contact 36 includes a flexible arm 53 having a proximal end 55 connected to the main body portion 37, and a free distal end 57 that carries a downwardly projecting tab 59. The latches 44 and 46 can each pivot about their respective proximal ends 49 and 55 with respect to the respective contact bodies 37 and 39 in a plane defined by the transverse-lateral directions.

The housing 32 is longitudinally elongate, and defines laterally opposing front and rear ends 50 and 52, respectively, transverse opposing upper and lower ends 54 and 56, respectively, and longitudinally opposing end walls 58. All connector housings 32 are described herein as being so oriented unless otherwise specified, it being appreciated that the orientation can change during use. The front end 50 provides a mating interface of the housing 32 that is configured to mate with a mating interface of a complementary a header connector or a card edge having contacts that are received in the contact-receiving space 47. The connector 30 is a right-angle connector, and thus the lower end 56 defines a mounting interface of the housing 32 that is configured to interface with a substrate, such as a printed circuit board. The rear end 52 defines an upper opening 255 and a lower opening 257, each configured to retain the rows 33 and 35 of electrical contacts 34 and 36, respectively.

The upper and lower ends 54 and 56 include first and second longitudinally extending rows 60 and 62 of ventilation windows 64 and 66 extending transversely therethrough that are in direct fluid communication with the power contacts 34 and 36 as illustrated. The row 60 of ventilation windows 64 is forwardly spaced with respect to the row 62 of ventilation windows 66. The ventilation windows 64 are laterally elongate, and extend transversely (or vertically) through the upper and lower ends 54 and 56 of the housing 32, such that windows 64 extending through the upper end 54 of the housing are aligned with windows 64 that extend through the lower end 56 of the housing 32. The windows 64 are disposed forward of the mating ends 40 and 45 of the contacts 34 and 36.

The ventilation windows 66 are longitudinally elongate, and extend transversely (or vertically) through the upper and lower ends 54 and 56 of the housing 32, such that windows 66 extending through the upper end 54 of the housing are aligned with windows 66 that extend through the lower end 56 of the housing. The laterally and longitudinal dimensions of the top and bottom windows 66 can be sized to provide contact-retention features 67 in the form of catches 69 that receive the top and bottom latches 44 and 46, and in particular the tabs 41, and can thus be sized substantially equal to or greater than those of the latches 44 and 46. For instance, the relative lateral dimensions of the latches 44 and 46 and the windows 66 can determine the amount of lateral float of the contacts 34 and 36 in the housing 32. If the lateral dimensions of the windows 66 are substantially equal to those of the latches 44 and 46, the contacts 34 and 36 will be locked in the housing 32 with respect to forward and backward relative movement. If the longitudinal dimensions of the windows 66 are substantially equal to those of the latches 44 and 46, heat will be permitted to dissipate from the contacts 34 and 36 through the upper end lower windows 66, respectively.

In this regard, ventilation windows, such as windows 66, can be used both for ventilation and cooling of the connector, along with contact retention. Thus, the windows 66 provide complementary engagement members 13, such as cantilevered latches or beams, that are configured to mate with the engagement members 15, such as catches, of the contacts 34 and 36. For instance, heat generated by the contacts 34 and 36 during use can flow out of the windows 66 of connector housing 32. While contact retention has been described with respect to windows 66, it should be appreciated that any windows of the connector 30, along with any of the connectors described herein, can provide contact retention features of the type described herein, for instance as a latch or a catch. In alternative embodiments, the ventilation windows 64 can further provide retention features that can receive latches extending from the contacts 34 and 36 in addition or as an alternative to the latches 44 and 46. In this regard, the engagement members 15 of the contacts 34 and 36 could comprise openings or pockets 61 and 63 that receive the engagement members 13 of the housing 32, which can include latches that are received in the pockets 61 and 63. The tails of the contacts 34 or 36 can be eye-of-the-needle or press-fit, with the engagement members 13, 15 combining to provide a retention force that exceeds a press-installation force that prevents dislodgement of the contacts 34 or 36 from the housing during installation of the connector on a surface of a PCB.

The contacts 34 and 36 can be installed in the housing 32 such that the latches 44 and 46 extend into the upper and lower windows 66, respectively. A plurality of contacts 34 and 36 can be installed into the housing 34 to define the top and bottom rows 33 and 35, respectively, of contacts whose mating ends 40 define vertically aligned contact blades 42. The resulting contact-receiving spaces 47 are configured to receive a complementary mating end of an electronic device such that heat generated at the interface of the connection can vent through top and bottom windows 64. The configuration of the power contacts 34 and 36 enables more mass than previously achieved, less contact resistance, a greater heat sink surface area, higher current capacity, and simpler design resulting in reduced manufacturing costs with respect to conventional power connectors.

In accordance with one embodiment, the contacts 34 and 36 are front end-loaded in the connector housing 32. In other words, in accordance with this embodiment, the contacts 34 and 36 are inserted into the front end 50 of the housing 32 in a direction toward the rear end 52. In order to provide the electrical contacts 34 and 36 as right-angle contacts, the contacts 34 and 36 are provided such that the angled spacer panel 73 and mounting end 38 initially extend horizontally in a direction coplanar with the horizontal panel 71, and the mounting end 43 extends horizontal and coplanar with the horizontal panel 83. The contacts 34 and 36 are inserted into the openings 255 and 257 formed in the rear end 52 of the housing 32 until the latches 44 and 46 engage the windows 66. Once the contacts 34 and 36 are positioned in the housing 32, the panels 73 and mounting ends 38 and 43 are bent to the configuration illustrated and described above with respect to FIGS. 2B-C. It should be appreciated that when front end loading electrical power contacts 34 and 36 into the connector housing 32, the mounting ends 38 and 43 are inserted through the connector housing 32. On the contrary, when electrical contacts are rear end loaded into connector housings in accordance with the construction of conventional connectors, the mating ends of the electrical contacts are inserted through the connector housings.

Because the portions of the contacts 34 and 36 that are inserted through the openings 255 and 257 are flat and coplanar, the openings 255 and 257 can be narrower and smaller than conventional openings in the front end of connector housings that receive the mating ends of contacts that are rear end-loaded into the housing. Accordingly, the height of the right angle connector housing 32 can be constructed with a low profile, having a height (i.e., transverse distance between the upper and lower ends 54 and 56) between approximately 6.5 mm and approximately 9.2 mm, for instance between approximately 7 mm and approximately 8.5 mm.

Additionally, because the openings 255 and 257 can be smaller than conventional contact-receiving openings that receive rear end-loaded contacts, additional dielectric material can be disposed between adjacent rows 33 and 35 of contacts 34 and 36. Thus, in accordance with one embodiment, the rows 33 and 35 can be spaced at a distance of approximately 1.1 to 2.5 mm, with the distance or gap measured from opposed contact mating surfaces in opposed rows or a distance measured tail to tail across opposed rows. For example, a mating gap may be about 1.1 mm and a tail gap may be about 2.5 mm. Stated another way, the rows 33 and 35 can be on a center-to-center pitch of about 2.7 mm since the power contact thickness is about 0.6 mm. Furthermore, the tails 70 can be longitudinally spaced from each other by a distance of approximately 1.8 mm, with the distance or gap measured from opposed tail surfaces along a common tail centerline that is parallel to a connector receiving slot. Stated another way, the tails 70 can be on a center-to-center pitch of about 2.5 mm. That is, the tails 70 of each contact 34 and 36 can be spaced apart at this distance, and adjacent tails 70 of adjacent contacts 34 and 36 along the respective rows 33 and 35 can be spaced apart at this distance. Accordingly, while the distance between adjacent tails 70 and the adjacent rows 33 and 35 can be dimensioned as desired, the connector 30 can be constructed as interchangeable with conventional connectors.

Furthermore, the increased dielectric material disposed between adjacent contacts 34 and 36, along with the heat dissipation provided by the ventilation windows 64 and 66, allows the electrical contacts 34 and 36 to have a thickness that is increased with respect to conventional electrical contacts. Therefore, in accordance with one embodiment, the thickness of the contacts 34 and 36 (and all electrical power contacts described herein) is approximately 0.6 mm. The contacts 34 and 36 (and all electrical power contacts described herein) can be made from a suitable conductive material having approximately 90% electrical conductivity. One example of a suitable material is XP10 or other suitable substitutes. It should thus be appreciated that front end-loading the electrical contacts 34 and 36 allows the power contacts 34 and 36 to have an increased thickness to power contacts of conventional connectors, and further allows the connector housing having a decreased size with respect to conventional connector housings.

Figure 3B:
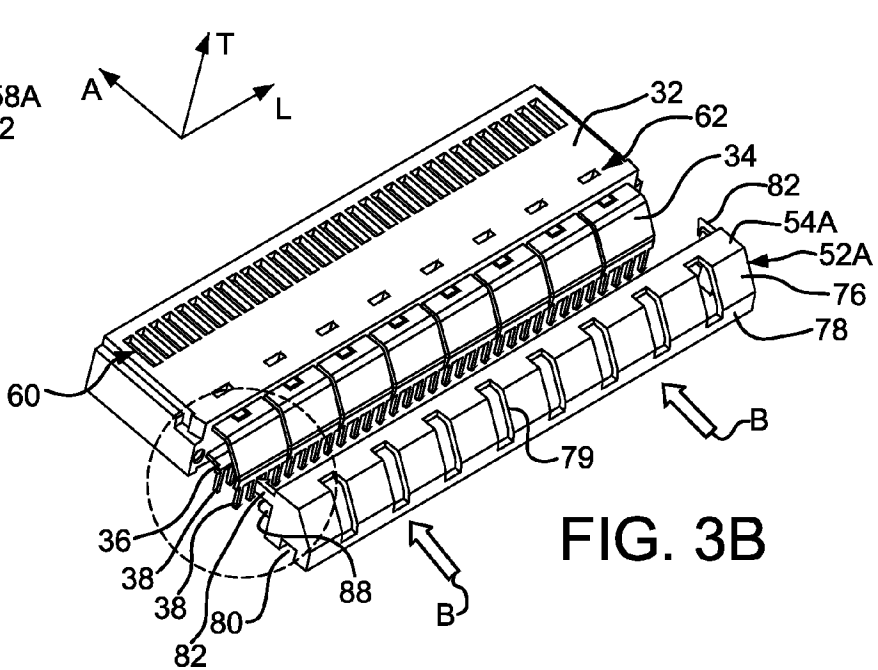
FIG. 3B is a perspective view showing the installation of the cover onto the electrical connector illustrated in FIG. 3A.
Figure 3A:
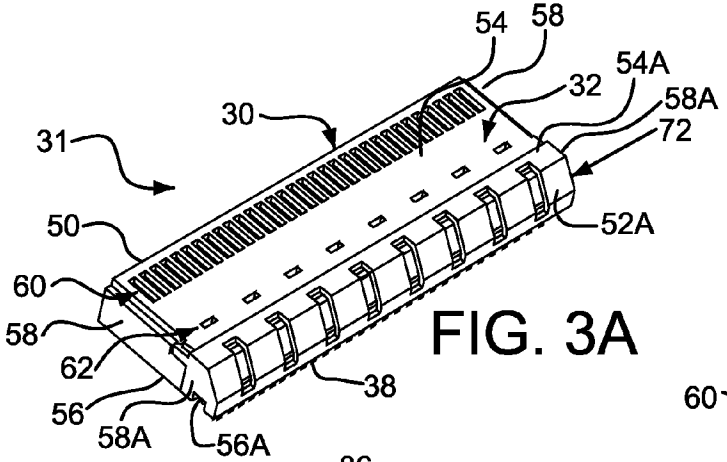
FIG. 3A is a perspective view an electrical power connector including a cover mounted onto the housing of the electrical receptacle connector illustrated in FIG. 2A.
Figure 3C:
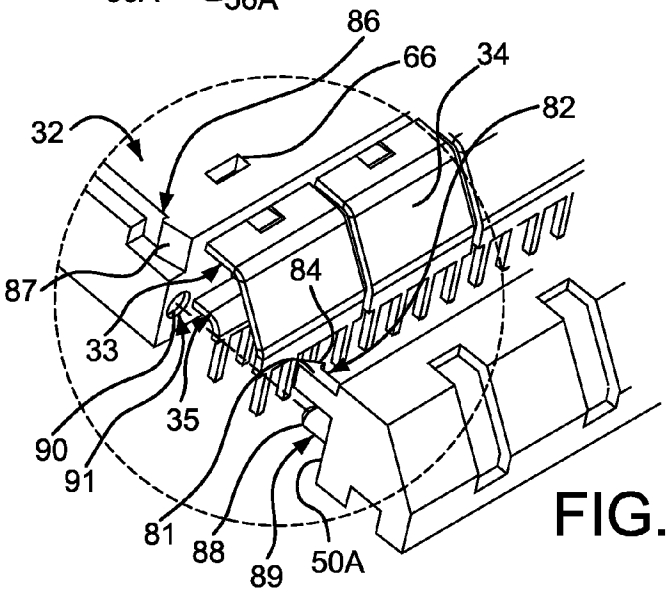
FIG. 3C is an enlarged perspective view of a portion of the electrical connector as illustrated in FIG. 3B, showing alignment and retention features.

Referring to FIGS. 3A-C, a protective cover 72 can be attached to the connector housing 32. The cover 72 further defines a upper end 54A, opposing side walls 58A, a front end 50A, and a rear wall 52A that includes an intermediate portion 76, and a bottom portion 78, and a lower end 56A. The intermediate portion 76 is angled laterally rearward and down from the rear end of the upper end 54A. The bottom portion 78 extends transversely down from the rear end of the intermediate portion 76. The cover 72 is configured to encapsulate a portion, or majority, of the rear, or mounting, ends 38 and 43 of the contacts 34 and 36, respectively, such that the entire contact bodies 37 and 39 are encapsulated by the housing 32 and the cover 72. Accordingly, only the mounting tails 70 extend below the lower end 56A of the cover 72. The cover 72 thus prevents or restricts operator access to energized components. A longitudinally elongate slot 80 extends transversely up into the lower end 56A, such that the mounting ends 38 of the contacts extend vertically through the slot 80. A plurality of longitudinally spaced ventilation windows 79 can extend through the cover 72, and in particular through the upper end 54A, the intermediate portion 76, and the bottom portion 78. Heat generated at the contacts 34 and 36 can escape through the ventilation windows 79.

The longitudinal dimension of the connector 30 (distance between opposing end walls 58 of the housing 32) can be anywhere between and including 70 mm and 90 mm, for instance 75 mm, 85 mm, 88 mm, or any alternative desired distance. The lateral, or horizontal, dimension of the connector 30 (distance between the front end 50 of the housing 32 and the rear end 52C of a cover 72 described below with reference to FIGS. 3A-C) can be between 15 mm and 25 mm, for instance approximately 20.5 mm. The transverse, or vertical, dimension of the connector 30 (distance between the top and bottom ends of the housing 32) can be between 5 mm and 12 mm, for instance about 7.5 mm. Of course, the connector 30 is not to be construed as limited to these dimensions.

The cover 72 can include latching and retention features at one or both longitudinal ends that mate with corresponding latching and retention features disposed at corresponding one or both longitudinal ends of the connector housing 32. In the illustrated embodiment, the cover 72 includes an engagement member 82 in the form of a latch 81 and a barb 84 projecting laterally inward from the latch 81. The connector housing 32 includes a corresponding engagement member 86 in the form of a catch 87 that is configured to mate with the barb 84 once the cover 72 is installed onto the housing 32. It should be appreciated that alternatively the housing 32 could include a latch and the cover 72 could include a mating catch.

The cover 72 can further include an alignment and/or retention at one or both longitudinal ends that mate with corresponding alignment and/or retention disposed at corresponding one or both longitudinal ends of the connector housing 32. In the illustrated embodiment, the cover 72 includes an auxiliary engagement member 89 in the form of a projection 88. The projection 88 can be cylindrical as illustrated, or can alternatively assume any shape. The connector housing 32 can include a complementary auxiliary engagement member 91 in the form of a recess 90 shaped and configured to receive the projection 88. The projection 88 can be loosely received in the recess 90 so as to provide an alignment guide, or projection 88 can be press-fit in the recess 90 so as to provide a retention feature. Alternatively, the housing 32 can include a pin and the cover can include a mating recess.

Accordingly, when the cover 72 is translated laterally toward the connector housing 32 along the direction of Arrow B, the projection 88 is received in the recess 90 to align and/or attach the cover to the housing 32. Furthermore, the engagement member 82 of the cover 72 mates with the corresponding engagement member 86 of the housing 32 to secure the cover 72 onto the housing 32.

Referring now to FIGS. 4A-D, an electrical right-angle receptacle connector 92 is constructed substantially identical or identical with respect to the connector 30 unless otherwise indicated. Thus, the connector 92 includes a connector housing 95 and power contacts 34 and 36 constructed substantially identical or identical with respect to the connector 30, unless otherwise indicated. The connector housing 95 is thus longitudinally elongate, and defines opposing front and rear ends 50B and 52B, respectively, opposing top and bottom walls 54B and 56B, respectively, and opposing end walls 58B. The connector 92 includes a plurality of signal contacts 94 provided as individual pins 115 having laterally forward extending mating ends 121 and opposing downwardly extending mounting ends 125. The signal contacts 94 can be arranged in one or more rows as described above with respect to the power contacts 34 and 36.

Figures 4A, 4B, 4C, 4D:
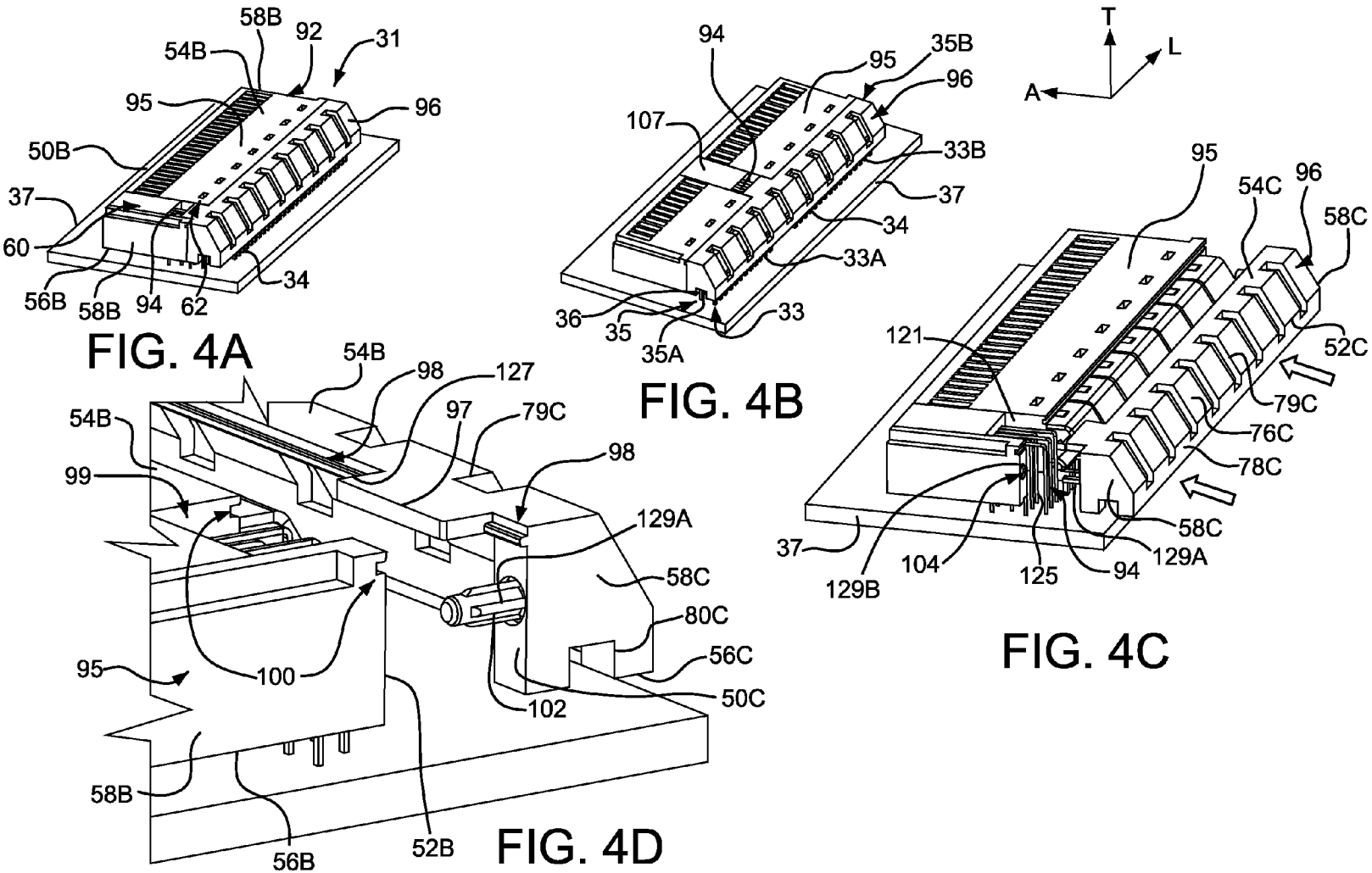
FIGS. 4A-B are perspective views of an electrical right-angle receptacle connector constructed in accordance with another example embodiment, including signal contacts positioned at different locations of the connector.
FIG. 4C is an assembly view of the electrical connector illustrated in FIG. 4A, showing the installation of the cover illustrated in FIGS. 4A-B.
FIG. 4D is an enlarged perspective view of a portion of the electrical connector as illustrated in FIG. 4C, showing alignment and retention features.

The signal contacts 94 can be disposed at either longitudinal end of the connector 92 as shown in FIG. 4A, or can be disposed between the longitudinal ends, for instance at or longitudinally offset from, the longitudinal center of the connector 92 as shown in FIG. 4B. Thus, the signal contacts 94 can be disposed in a middle portion 107 of the housing 95, such that the signal contacts 94 are disposed between power contacts 34 and 36, and separate the rows 33 and 35 into corresponding row segments 33A and 33B, and 35A and 35B. In the illustrated embodiment, the signal contacts 94 are longitudinally offset with respect to a longitudinal center of the housing 95 and rows 33 and 35, though it should be appreciated that the signal contacts 94 could be disposed anywhere along the housing 95. In one embodiment, twenty-eight power contacts 34 and 36 are provided in two rows of fourteen contacts, and twelve signal contacts 94 are provided, though the connector 92 is not to be construed as limited to this configuration.

The connector 92 can include a cover 96 constructed sized and shaped as described above with respect to the cover 72, but configured to encapsulate the signal contacts 94 and the power contacts 34. Thus, the cover 96 defines a upper end 54C, opposing side walls 58C, a front end 50C, and a rear wall 52C that includes an intermediate portion 76C, and a bottom portion 78C, and a lower end 56C. A plurality of longitudinally spaced ventilation windows 79C can extend through the cover 96, and in particular through the upper end 54C, the intermediate portion 76C, and the bottom portion 78C. Heat generated at the contacts can escape through the ventilation windows 79C. Thus, a first row of windows 60, a second row of windows 62, and a third row of windows 79C that extend through the connector 92 and are in direct fluid communication with the power contacts as illustrated. As illustrated, the first and second rows of windows 60 and 62 extend through the housing 95, and the third row of windows 79C extends through the cover 96. A longitudinally elongate slot 80C extends transversely up into the lower end 56C in alignment with the mounting ends 38 of the contacts to provide for additional heat dissipation.

The cover 96 can also include latching, alignment, and retention features usable in combination with, or instead of, the alignment and retention features of cover 72. In particular, the cover 96 includes a laterally outwardly projecting tab 98 that extends longitudinally along the front end 50C of a rectangular pocket 127 formed in the upper end of the front wall 50C of the cover 96. The tab 98 is illustrated having a rectangular cross-section, though any suitably sized and shaped tab is contemplated. A complementary longitudinally elongate recess 100 projects laterally forward into the rear wall 52B of the connector housing 95, and is aligned with and configured to receive the tab 98. The recess 100 is has a shape that is substantially the same shape as the tab 98, and sized substantially equal to or slightly greater than the tab 98 in the transverse and/or lateral directions such that the tab 98 is configured to fit within the recess 100. The recess 100 can thus receive the tab 98 snugly or loosely depending on the desired amount of lateral and/or transverse float that the cover 96 will have with respect to the connector housing 95. Alternatively, the connector housing 95 can include a projecting tab and the cover 96 can include a recess that receives the tab.

The cover 96 can also include a laterally outwardly projecting tab 97 that is laterally elongate and disposed adjacent the pocket 127. The tab 97 is illustrated as having a rectangular profile, though any suitably sized and shaped tab is contemplated, and defines one wall of the pocket 127. The tab 97 is aligned with, configured to fit within, a complementary recess 99 formed in the connector housing 95. The recess 99 has a shape that is substantially the same shape as the tab 97, and sized substantially equal to or slightly greater than the tab 97 in the transverse and/or lateral directions such that the tab 97 is configured to fit within the recess 99. The recess 99 can thus receive the tab 97 snugly or loosely depending on the desired amount of lateral and/or transverse float that the cover 96 will have with respect to the connector housing. Alternatively, the connector housing 95 can include a projecting tab and the cover 96 can include a recess that receives the tab.

It should be appreciated that the cover 96 and connector housing 95 can include as many tabs 97 and 98 and respective complementary recesses 99 and 100 as desired. For instance, in the illustrated embodiment, each longitudinal end of the connector housing 95 and cover includes a tab 97 and recess 99 disposed between a pair of tabs 98 and recesses 100.

The cover 96 can also include an alignment and/or retention feature 129A at one or both longitudinal ends that mate with a corresponding alignment and/or retention feature 129B disposed at one or both longitudinal ends of the connector housing 95. In the illustrated embodiment, the feature 129A is a post 102 that is cylindrical, though could be any suitable shape, extending laterally forward from the front end 50C of the cover 96. The post 102 can be disposed anywhere along the transverse direction, and is disposed substantially transversely midway along the front end 50C. The feature 129B includes a recess 104 shaped as described with respect to the post 102 that extends into the rear end 52B of the connector housing 95. The recess 104 is aligned with the post 102, and configured to receive the post 102. The post 102 can be loosely received in the recess 104 so as to provide an alignment guide, or the post 102 can be press-fit in the recess 104 so as to retain the cover 96 and the connector housing 95 in an attached configuration. Alternatively, the housing 95 can include one or more posts such as post 102 and the cover 96 can include one or more mating recesses such as recess 104.

The connector 92 can include as many posts 102 and recesses 104 as desired. As illustrated, the post 102 and recess 104 are disposed longitudinally outward with respect to the tab 97 and recess 99, and in vertical alignment with the tab 98 and recess 100. Thus, the features 129A-B can be disposed at opposing longitudinal outer ends of the connector 92.

Referring now to FIGS. 5A-F, an electrical right-angle receptacle connector 92' is constructed substantially identical or identical with respect to the connector 92 unless otherwise indicated. Thus, the connector 92' is illustrated having reference numerals corresponding to like elements of the connector 92 including an apostrophe (') for the purposes of form and clarity. The connector 92' includes a connector housing 95' that is longitudinally elongate, and defines opposing front and rear ends 50B' and 52B', respectively, opposing top and bottom walls 54B' and 56B', respectively, and opposing end walls 58B'. The connector 92' includes a plurality of signal contacts 94' which can be constructed as described above with respect to signal contacts 94, and arranged in one or more rows as described above with respect to the power contacts 34' and 36'. Thus, the mating ends 40' and 45' of the power contacts 34' and 36' are disposed proximate to the front end 50B' of the housing 95'.

The housing 95' includes a main housing portion 118' and a neck 116'. The neck 116' defines the front end 50B' of the housing 95', and defines a longitudinal length and transverse height slightly less than that of the main housing portion 118'. The neck 116' is positioned to surround the mating ends 40' and 45' of the electrical power contacts 34' and 36', and the mating ends 121' of the signal contacts 94'.

The connector 92' can include a cover 96' configured to encapsulate the signal contacts 94' and the power contacts 34'. Thus, the cover 96 defines a upper end 54C', a lower end 56C', opposing side walls 58C', a front end 50C', and a rear wall 52C' that extends transversely between the upper end 54C' and the lower end 56C'. A first plurality of longitudinally spaced ventilation windows 79C' extends transversely through the upper end 54C' of the cover 96', and a second plurality of longitudinally spaced ventilation windows 65C' extends laterally through the rear wall 52C'. Heat generated at the contacts can escape through the ventilation windows 65C' and 79C'. Thus, a first row of windows 60', a second row of windows 62', a third row of windows 79C', and a fourth row of windows 65C' extend through the connector 92'. Each window in the rows of windows are in direct fluid communication with the power contacts in the illustrated embodiment.

As illustrated, the first and second rows of windows 60' and 62' extend through the housing 95', and the third and fourth rows of windows 79C' and 65C' extend through the cover 96'. The windows 79C' are laterally elongate, and can be aligned with the underlying contact 34 and 36, and disposed longitudinally central with respect to the underlying contact 34. The windows 65C' are transversely elongate, and disposed longitudinally between adjacent contacts 34 and 36. Thus, the windows 79C' and 65C' are longitudinally staggered, and spaced approximately half the distance of the longitudinal length of each contact 34' and 36'. It should be appreciated that the windows 65C' and 79C' could be alternatively positioned. For instance, the windows 65C' could be aligned with the contacts 34' and 36', and that the windows 79C' could be disposed between adjacent contacts 34' and 36'. A longitudinally elongate slot 80B' extends through the housing 95', and in particular through the neck 116' at a location proximate to the front end 50B' and in alignment with the mating ends of the contacts to provide for additional heat dissipation.

Figures 5A, 5B, 5D:
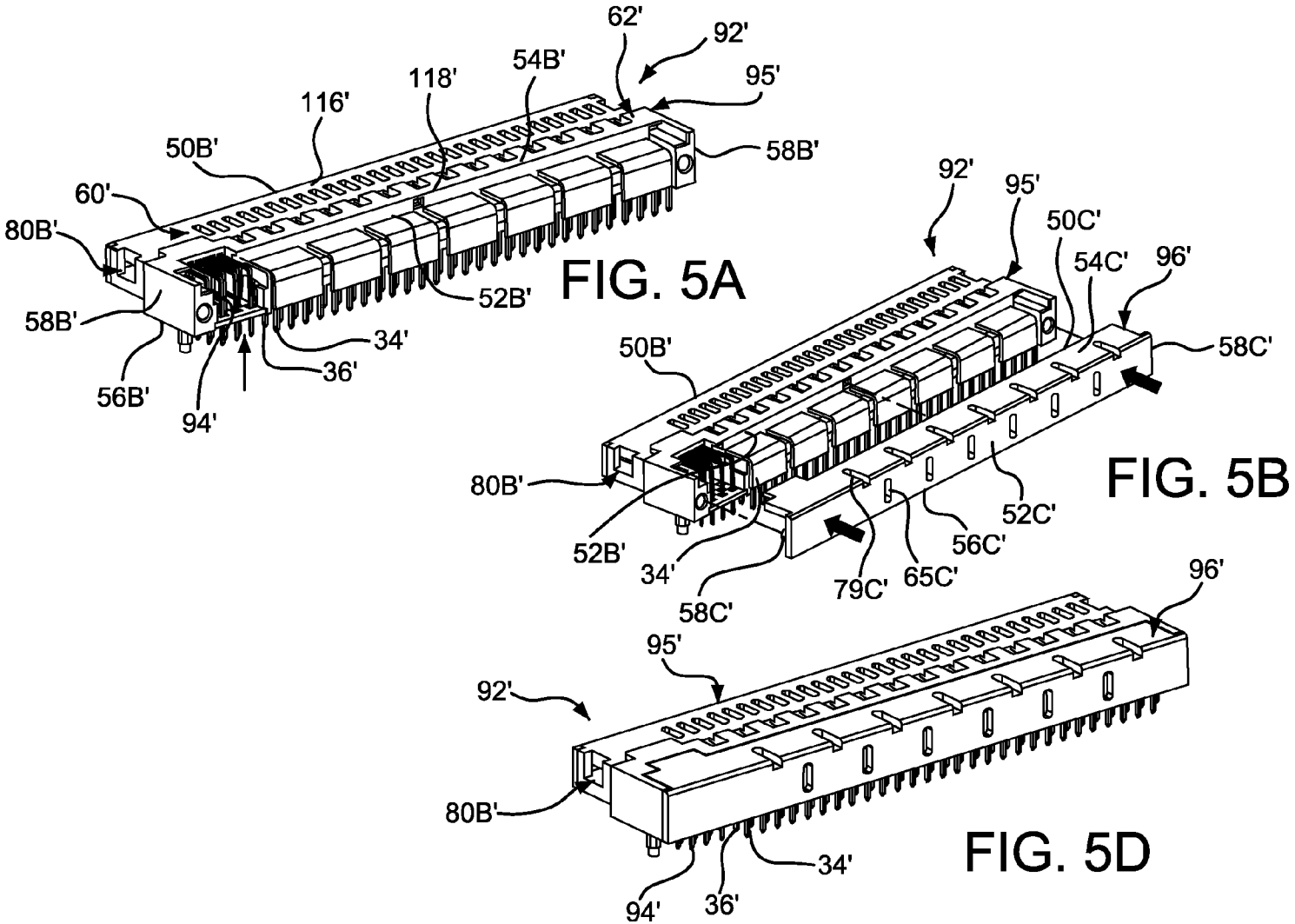
FIGS. 5A-5F show an electrical right-angle receptacle connector similar to that illustrated in FIGS. 4A-D, but constructed in accordance with an alternative embodiment.
Figure 5C:
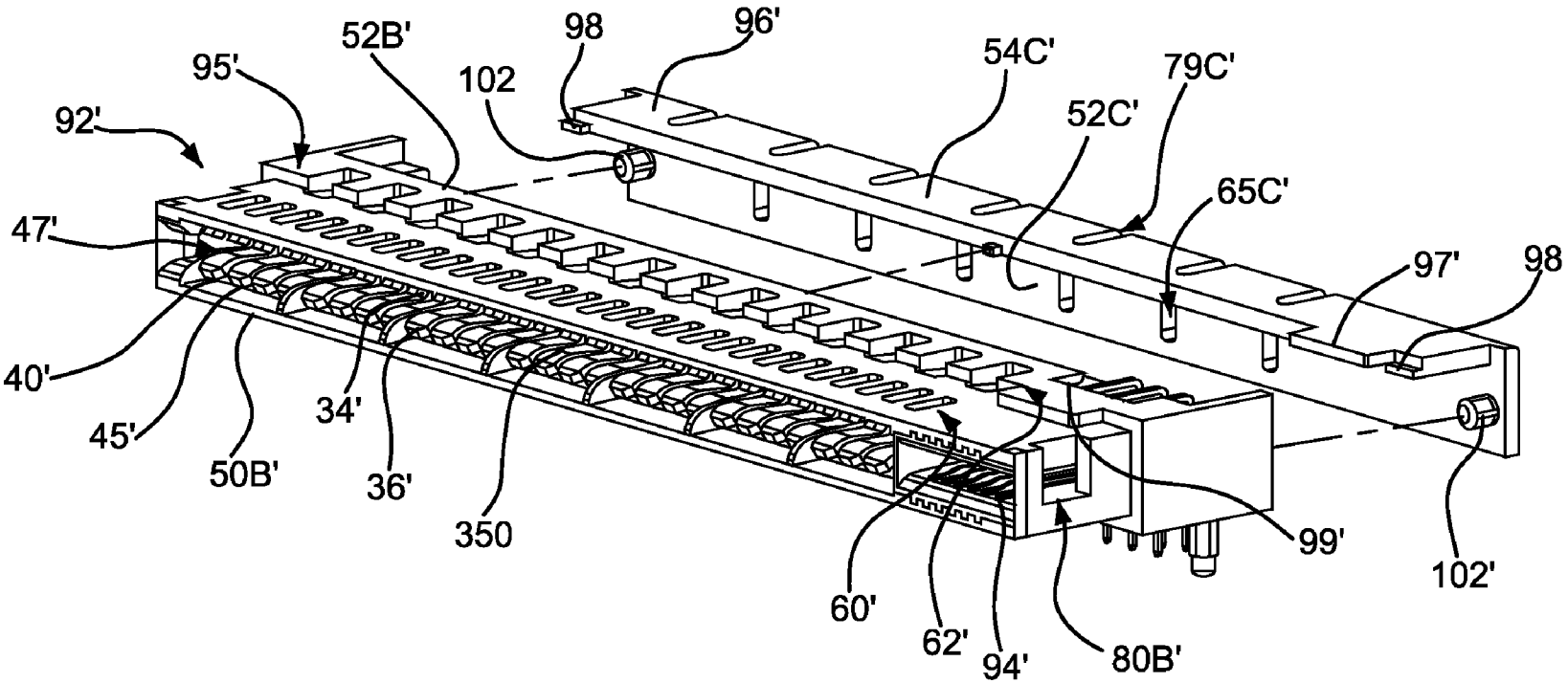
Figure 5G:
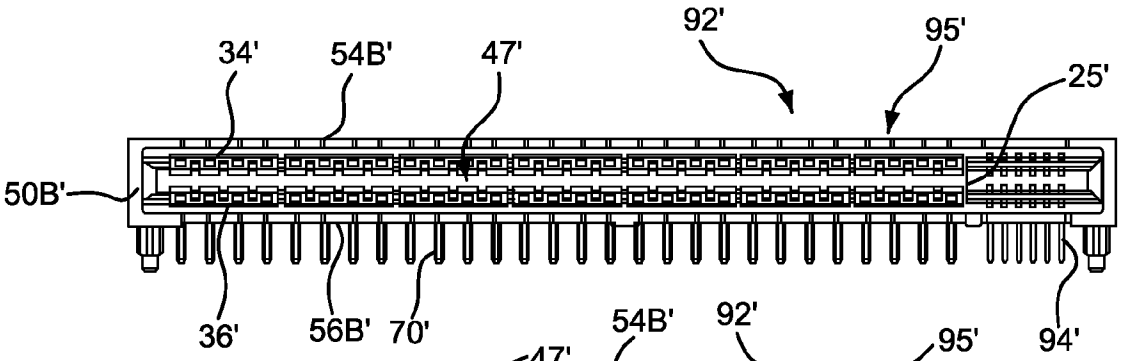
FIG. 5G is a front elevation view of the electrical connector as illustrated in FIGS. 5A-F, but including a polarization wall in accordance with another embodiment.
Figure 5E:
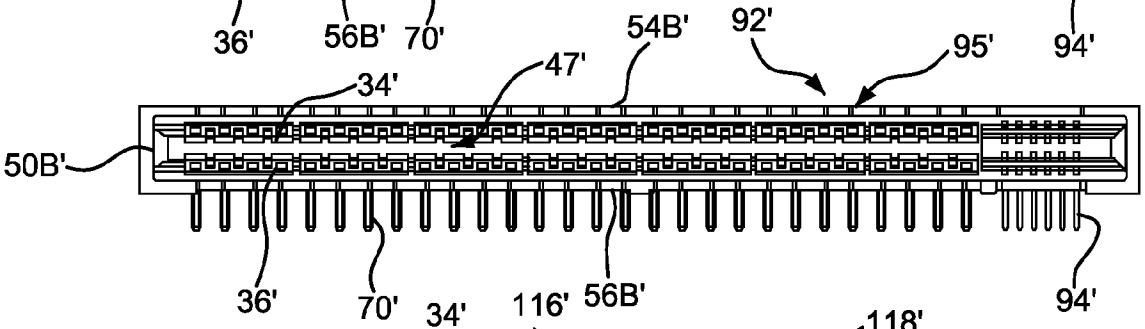
Figure 5F:
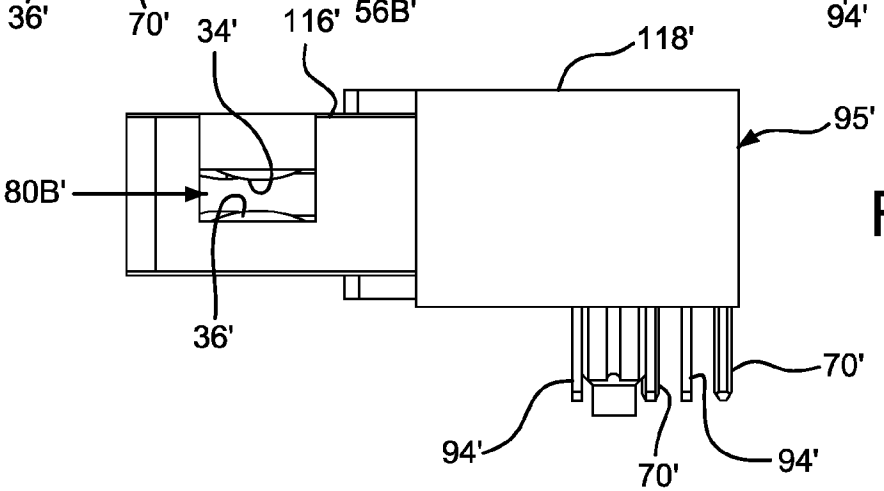

Referring to FIG. 5G, the connector 92' can include a polarization wall 25' disposed longitudinally between the signal contacts 94 and the power contacts 34 and 36. The polarization wall 25 extends transversely between the upper and lower ends 54B' and 56B' of the housing 95' at a location offset with respect to the longitudinal center of the housing 95'. A header connector or card edge configured to mate with the connector 92' would thus include a slot configured to receive the polarization wall 25 to ensure that the mating connectors/card edge are in their proper orientation when mated.

Figure 6B:
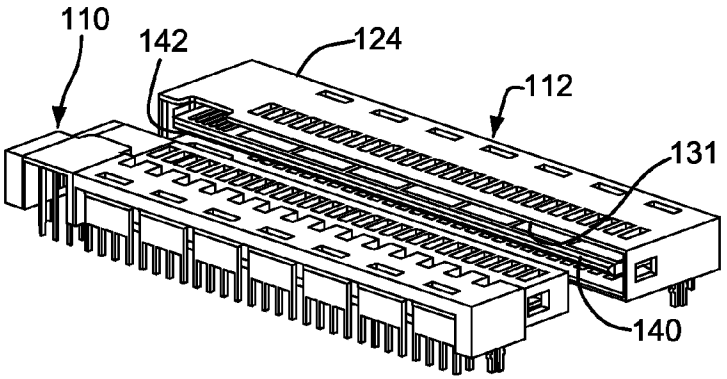
FIGS. 6A-6C show an electrical power connector assembly including an electrical right-angle receptacle connector connected to an electrical right-angle header connector.
Figure 6C:
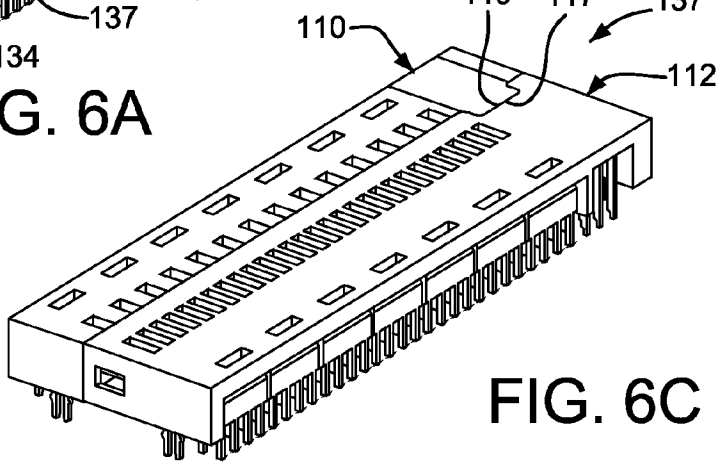
Figure 6A:
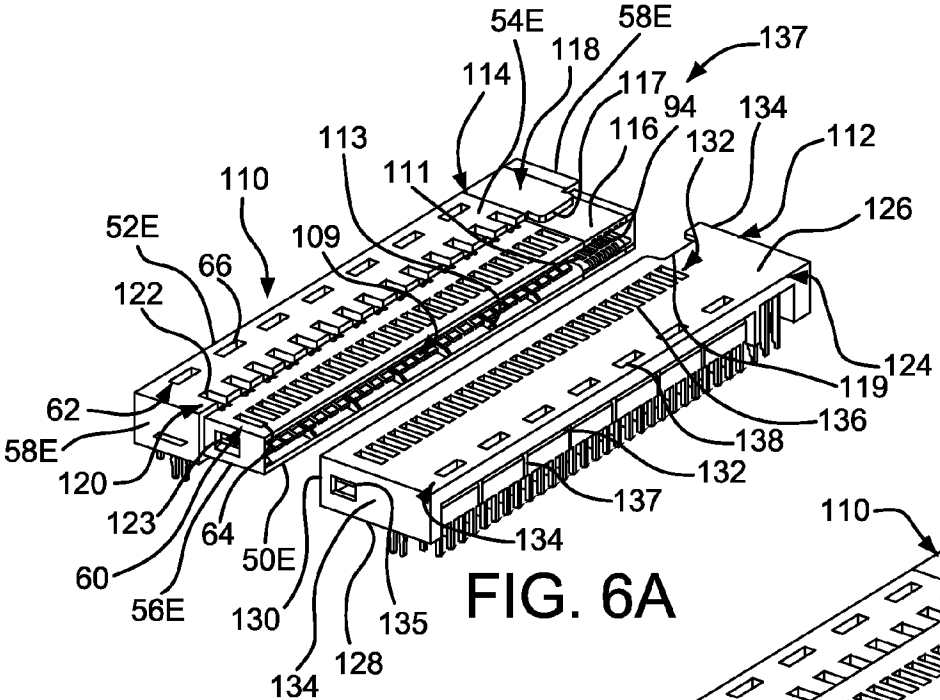
Figure 16A:
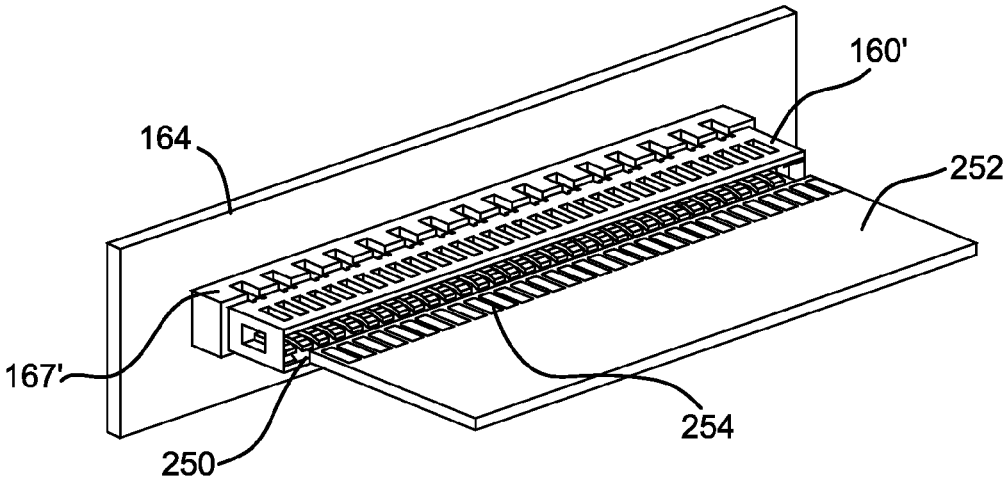
FIGS. 16A-B show a vertical electrical receptacle connector that receives an edge of a power daughter card.
Figure 16B:
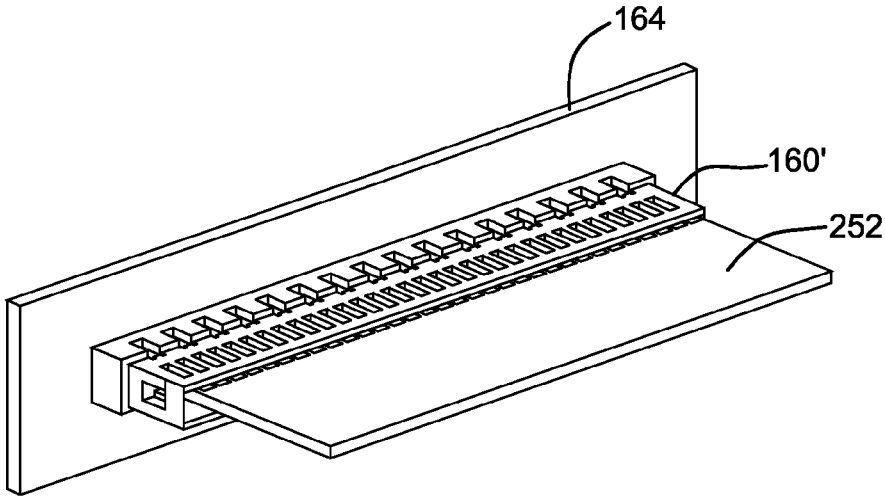

Referring now to FIGS. 6A-C, an electrical power connector assembly 137 includes a right-angle receptacle power connector 110 and a complementary right-angle header power connector 112 configured for connection to each other. The receptacle connector 110 can be constructed generally in the manner described above, and includes a connector housing 114 as described above that retains power contacts 34 and 36 as described above. For instance, the housing 114 includes opposing front and rear ends 50E and 52E, respectively, opposing top and bottom walls 54E and 56E, respectively, and opposing end walls 58E. The housing 114 includes a main housing portion 118 and a neck 116. The neck 116 defines the front end 50E of the housing 114, and defines a longitudinal length and transverse height slightly less than that of the main housing portion 118. The neck 116 is positioned to surround the mating ends 40 and 45 of the electrical power contacts 34 and 36, and the mating ends 121 of the signal contacts 94. The connector 110 is illustrated as being configured for connection to an electrical right-angle header connector 112 in a co-planar application, as well as a card edge such as the card edge 250 of a daughter card, which can be provided as a power card 252 as illustrated in FIGS. 16A-B.

The connector housing 114 includes a third laterally extending row 120 of windows 122 that extend vertically through the top and bottom walls 54E and 56E of the housing 114. The windows 122 can extend through the main housing portion 118 alone, the neck 116 alone, or can extend through both the main housing portion 118 and the neck 116. The windows 122 are thus disposed laterally between the windows 64 and 66. The windows 122 are laterally elongate, and thus extend parallel to the windows 64, while the windows 66 are longitudinally elongate and perpendicular with respect to the windows 64 and 122. The windows 122 are spaced longitudinally apart a distance greater than the windows 64, which can be spaced apart a distance substantially equal to or equal to the row pitch of the contacts 34 and 36, such as 2.54 mm (or 0.10 in). The connector housing 114 can further include windows 123 that extend horizontally through one or both end walls 58E of the housing 114. The windows 123 are at least in partial longitudinal alignment with the windows 122, such that a transverse axis through a window 123 and a longitudinal axis extending through a window 122 can intersect.

The front end of the connector housing 114 includes an opening that defines a first mating end 109 configured to receive the mating ends of electrical power contacts, and a second mating end 111 configured to receive the mating ends of electrical signal contacts.

The header connector 112 can include a header connector housing 124 having a top end 126, bottom end 128, front end 130, rear end 132, and opposing sides 134. The front end 130 provides a mating end that includes defines a shroud 131 sized to receive the neck 116 of the receptacle housing 114. The shroud 131 further defines an opening 133 configured to receive plug contacts 140 and signal blade contacts 142. The header housing 124 further includes two laterally extending rows 153 and 155 of windows 136 and 138, respectively, that extend vertically through the header housing 124.

The housing 114 includes a plurality of longitudinally spaced dividers 113 that extend vertically up from the lower end 56E into the opening 109. Longitudinally adjacent dividers 113 define a guide 139 that is sized to receive the contacts 140 of the connector 112. Thus, the blade contacts 140 are spaced longitudinally apart from each other a distance substantially equal to, or slightly greater than, the longitudinal thickness of the dividers 113. Likewise, the dividers 113 are spaced longitudinally apart from each other a distance substantially equal to, or slightly greater than, the longitudinal length of the blade contacts 140. The dividers 113 extend upward from the bottom 56E a distance sufficient to extend between the blade contacts 140. Alternatively or additionally, the dividers 113 could extend down from the upper end 54E of the housing 114.

The connectors 110 and 112 can define a longitudinal dimension, or length (distance between the opposing end walls of the housings 114 and 124, respectively) of anywhere between and including 70 mm and 90 mm, for instance 75 mm, 85 mm, 88 mm, or any alternative desired distance. The lateral, or horizontal, dimension of the connectors 110 and 112 (distance between the front and rear ends of the housings 114 and 124, respectively) can be between 15 mm and 25 mm, for instance approximately 20.5 mm. The transverse, or vertical, dimension of the connectors 110 and 112 (distance between the top and bottom ends of the housings 114 and 124, respectively) can be between 5 mm and 12 mm, for instance about 7.5 mm. Of course, the connectors are not to be construed as limited to these dimensions.

The receptacle connector 110 can further include a tab 117 disposed on the top end of the housing 114 that is configured to align with, and be inserted into, a complementary pocket 119 formed in the top end 126 of the header connector housing 124. Alternatively, the receptacle housing 114 can include a recess and the header housing 124 can include a tab.

Referring now to FIGS. 7A-D and FIGS. 8A-D, the right-angle header connector 112 is illustrated as being attached to a substrate 144. The card edge contacts 140 each includes rows of upper and lower contact 146 and 148, respectively, each having a blade 149 connected at its rear end to downwardly extending mounting tails 141 that are configured to electrically connect to complementary electrical traces or contacts of the substrate 144 as described above. The blade 149 of the upper contact 146 has a lateral length that is longer than the blade 149 of the lower contact 148, such that the mounting tails 141 of the upper contact 146 are disposed behind the mounting tails 141 of the lower contact 148. The contacts 146 and 148 include four split mounting tails 141 in the manner described above, however any number of split tails greater than or equal to one (for instance at least two, at least three, or more than four) are contemplated. Accordingly, the mating ends of the contacts 146 and 148 define a longitudinal dimension that is equal to or greater than the distance between the longitudinally outermost mounting tails of the contacts.

In accordance with one embodiment, the contacts 146 and 148 are front end-loaded in the header housing 124. In other words, in accordance with this embodiment, the contacts 146 and 148 are inserted into the front end opening 133 of the housing 124 in a direction toward the rear end of the housing 124. In order to provide the electrical contacts 146 and 148 as right-angle contacts, the contacts 146 and 148 are inserted into the openings 133 in a horizontal coplanar configuration. Once the contacts 146 and 148 are positioned in the housing 124, the contacts 146 and 148 are bent to the right-angle configuration illustrated in FIGS. 7A-D.

Because the portions of the contacts 146 and 148 that are inserted through the openings housing 124 are flat and coplanar, the openings in the housing that receive the contacts 146 and 148 at the rear end of the housing 124 can be narrower and smaller than conventional openings in the front end of connector housings that receive the mating ends of contacts that are rear end-loaded into the housing. Accordingly, the height of the right angle connector housing 124 can be constructed with a low profile, having a height (i.e., distance between the upper and lower ends of the housing 124) between approximately 7.5 mm and approximately 9.2 mm, for instance between approximately 7.5 mm and approximately 9.0 mm.

In accordance with one embodiment, the mounting ends 141 of the adjacent contacts 146 and 148 can be spaced at a distance of approximately 2.54 mm (or approximately 0.10 in). Furthermore, the tails 141 can be longitudinally spaced from each other along each row by a distance of approximately 2.54 mm (or approximately 0.10 in). That is, the tails 141 of each contact 146 and 148 can be spaced apart at this distance, and adjacent tails 141 of adjacent contacts 146 and 148 along the respective rows can be spaced apart at this distance. The connector 112 can be constructed as interchangeable with conventional connectors.

The mating ends of the upper power contacts 146 are chamfered at a 45° angle with respect to the horizontal, and the mating ends of the lower power contacts 148 are also chamfered at a 45° degree angle with respect to the horizontal. In the illustrated embodiment, the lower chamfers are oriented opposite with respect to the upper chamfers. It should further be appreciated that the chamfers can form any angle between 0° and 90° as desired.

Figure 8A:
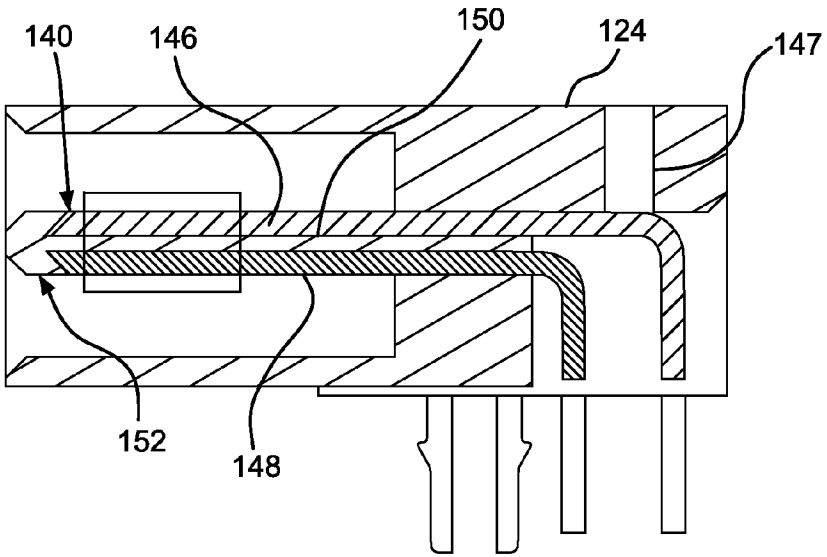
FIG. 8A is a sectional elevation view of the electrical right-angle header connector as illustrated in FIG. 7B, but enlarged.
Figure 8B:
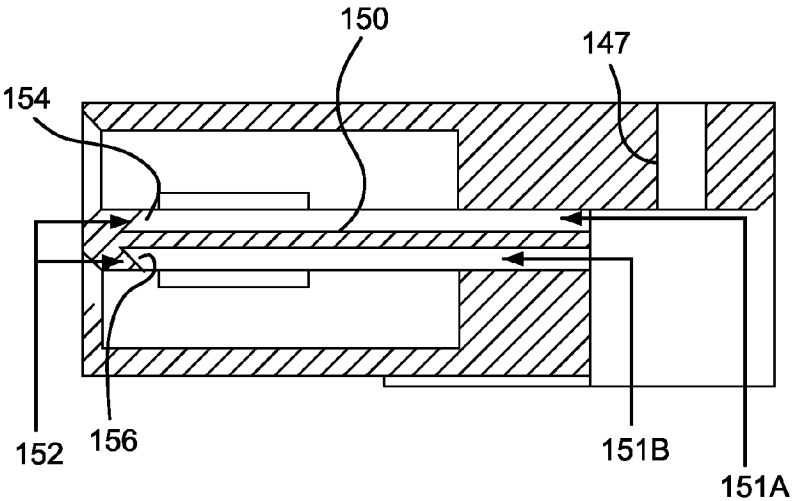
FIG. 8B is a sectional elevation view of the electrical right-angle header connector as illustrated in FIG. 8A, but without the electrical contacts installed.
Figure 8D:
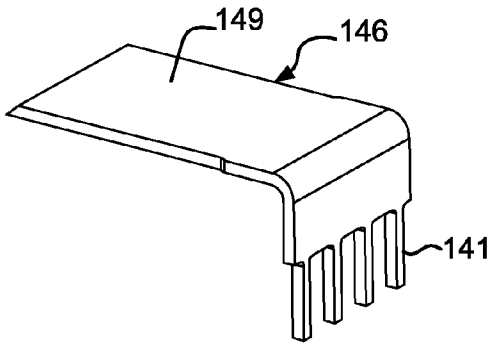
FIG. 8D is a perspective view of a top power contact of the electrical connector illustrated in FIG. 8A.
Figure 8C:
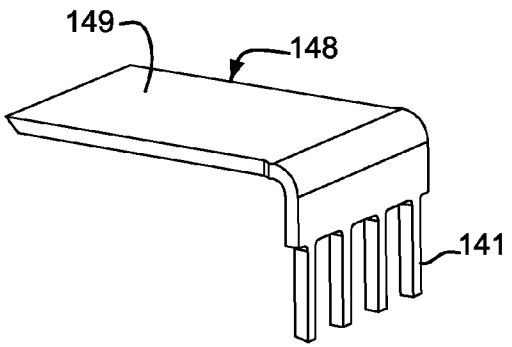
FIG. 8C is a perspective view of a bottom power contact of the electrical connector illustrated in FIG. 8A.

As shown in FIG. 8B, the header housing 124 includes a dielectric divider 150 that separates the housing 124 into upper and lower contact slots 151A and 151B, respectively. The front end of the dielectric divider 150 includes a retaining structure 152 that contains upper and lower chamfered pockets 154 and 156, respectively, sized to receive chamfered front ends of the upper and lower power contact blades 146 and 148, respectively. Accordingly, the upper and lower power contact blades 146 and 148 are inserted into the rear of the housing 124 along the direction of Arrows A and B, respectively, until that the front ends of the contact blades 146 and 148 abut the dielectric divider 150 inside the pockets 154 and 156.

It should be appreciated that the dielectric divider 150 prevents the upper and lower contact blades 146 and 148 from being in electrical communication with each other in the housing 124. Accordingly, though the contacts 146 and 148 are both electrically attachable to a common substrate 144, they are electrically insulated from each other by the dielectric divider 150. As a result, when the card edge 140 is inserted into a contact-receiving space, such as the contact-receiving space 47 disposed between the mating ends 40 and 45 of vertically aligned contacts 34 and 36 as described above, the upper receptacle contact 34 mates with the upper blade 146, and the lower receptacle contact 36 mates with the lower blade 148. The upper contact 34 and upper blade 146 are thus electrically connected to each other in the connector assembly, and the lower contact 36 and lower blade 148 are electrically connected to each other when the connectors 110 and 112 are mated, however the upper contact 34 and upper blade 146 are electrically isolated from the lower contact 36 and lower blade 148 when the connectors 110 and 112 are mated. For instance, a direct electrical path through electrically conductive material cannot be established between an upper contact 34 and a lower contact 36 (or an aligned contact 36).

The contacts 146 can include a engagement member, such as a latch of the type illustrated and described above with reference to FIGS. 2A-C, that is configured to interlock with a complementary engagement member illustrated as an opening 147 formed in the housing 124. Alternatively or additionally, the contacts 146 can be retained in the housing 124 by frictional forces imparted onto the contacts 146 by the housing 124, for instance by the dielectric divider 150 and the surrounding housing structure.

The signal blade contacts 142 include upper and lower signal contact beams 143 and 145 that can be installed in the header housing 124 in accordance with any alternative known method. The upper and lower signal blade contact beams 143 and 145 can define differential pair, or can be single-ended as desired.

Figure 9A:
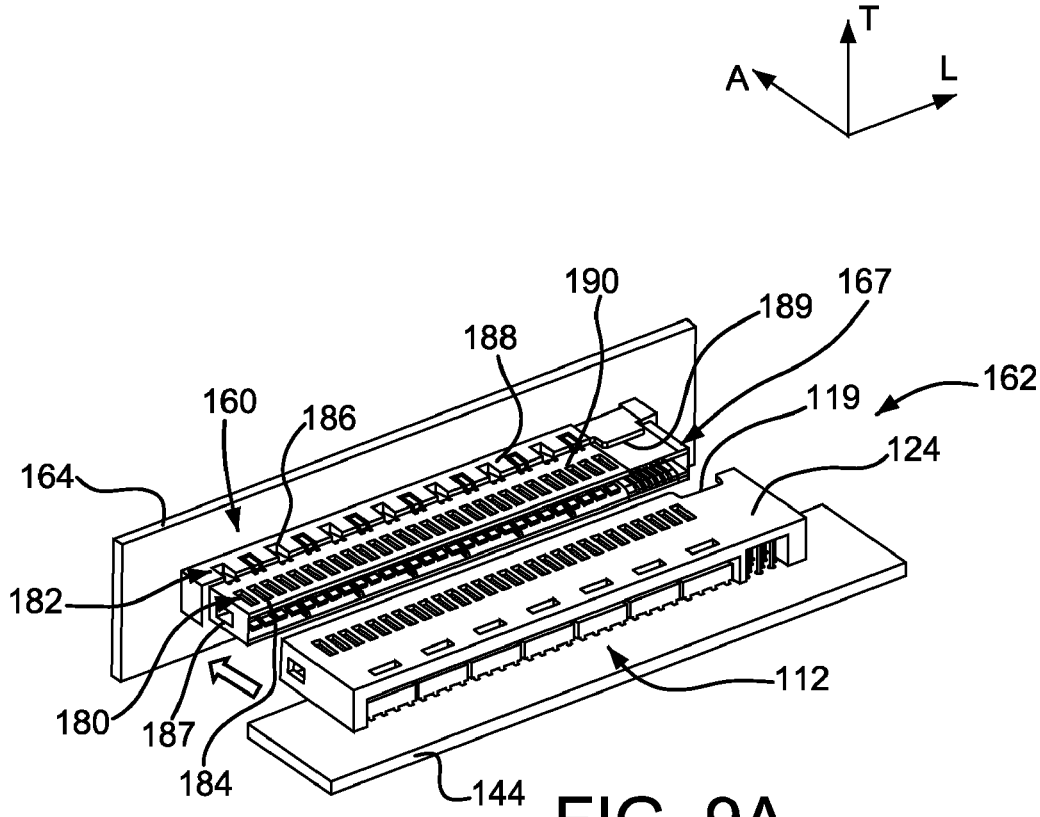
FIGS. 9A-B are perspective views of the electrical right-angle header connector mated with an electrical vertical receptacle connector constructed in accordance with an example embodiment.
Figure 9B:
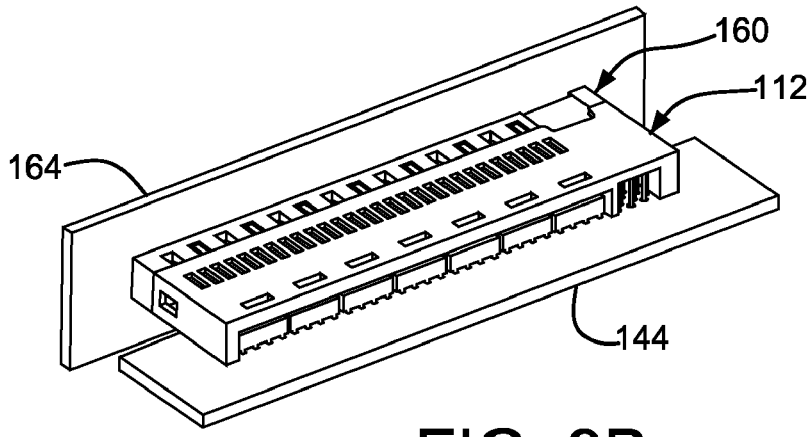
Figure 10C:
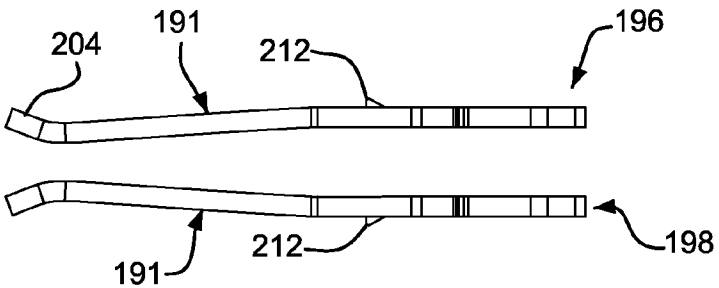
FIG. 10C is an assembly view of top and bottom rows of the electrical contacts illustrated in FIG. 10B being installed in a vertical receptacle connector housing.
Figure 10A:
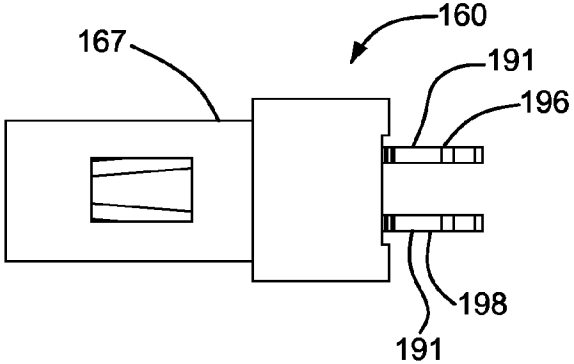
FIG. 10A is a perspective view of an electrical power contact configured for installation in an electrical vertical receptacle having retainer features constructed in accordance an example embodiment.
Figure 10D:
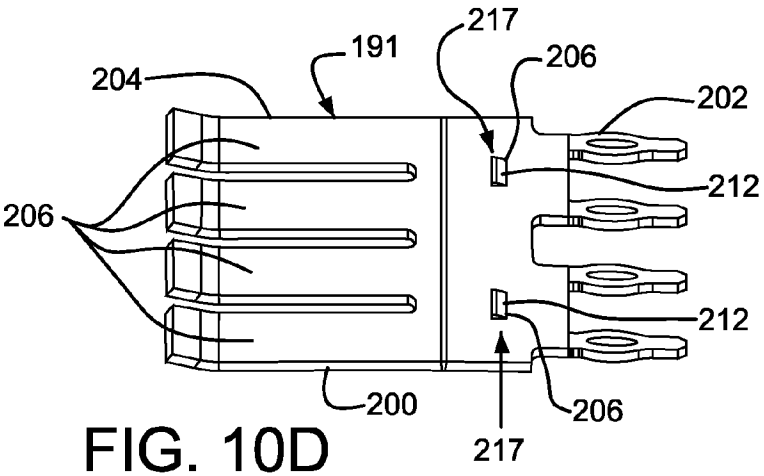
FIG. 10D is an elevation view of the electrical contacts installed in the vertical receptacle connector housing.
Figure 10B:
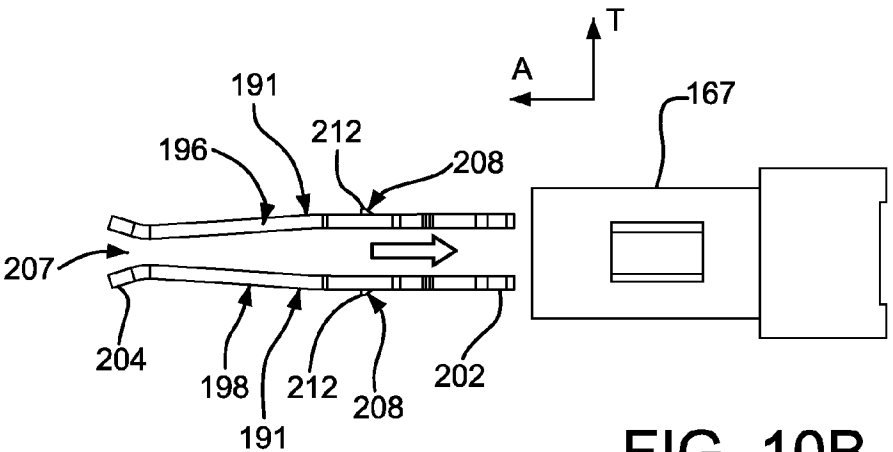
FIG. 10B is an elevation view of top and bottom electrical power contacts of the type illustrated in FIG. 10A.

It should be appreciated that while the receptacle connector 110 has been illustrated as a right-angle connector, the receptacle connector 110 could alternatively be constructed as a vertical connector, such as the connector 160 illustrated in FIGS. 9A-B. For instance, a power connector assembly 162 includes the vertical connector 160 mated to an electrical component, such as the connector 112. The connector 160 is shown mated at its mounting end to a substrate 164, while the right-angle header connector 112 is shown mated at its mounting end to the substrate 144 as described above. When the connectors 112 and 160 are mated to provide an electrical connector assembly 162, the substrates 164 and 144 extend at a right angle with respect to each other when attached to the connectors 112 and 160. The vertical receptacle connector 160 will now be described with further reference to FIGS. 10A-D and FIGS. 14A-D.

With initial reference to FIGS. 14A-D, the vertical receptacle connector 160 includes a receptacle connector housing 167 that can be constructed generally as described above with respect to the right-angle receptacle housing 114 described above. Thus, the housing 167 is longitudinally elongate, and defines a front end 170 and an opposing rear end 172, a top end 174 and an opposing bottom end 176, and opposing end walls 178. The front end 170 defines a first mating end 177 configured to receive the mating ends of electrical power contacts, and a second mating end 179 configured to receive the mating ends of electrical signal contacts. In other words, the front end 170 defines a mating interface of the connector 160. Because the receptacle connector 160 is a vertical connector, the rear end 172 defines a mounting interface of the connector 160 that is configured to interface with an underlying substrate, such as a printed circuit board. A plurality of vertical dividers 181 extends up into the opening 177 from the bottom end 176, and is constructed in the manner described above with respect to the dividers 113. Thus, the dividers 181 provide guides that are configured to receive corresponding blade contacts of a complementary connector, such as the right-angle header connector 112 illustrated in FIGS. 9A-B.

Referring also to FIGS. 9A-B, the housing 167 includes a raised housing portion 188 and a recessed neck 190 that extends forward from the raised housing portion 188. The raised housing portion 188 can include a tab 189 configured to be received in the pocket 119 of the right-angle header connector 112. Alternatively the header connector 112 can include a tab and the vertical receptacle connector 160 can include a slot. In this regard, it should be appreciated that any two connectors that mate can include interlocking tabs and slots constructed similar to tab 189 and pocket 119.

The top and bottom ends 174 and 176 of the housing 167 include a pair of longitudinally extending rows 180 and 182 of ventilation windows 184 and 186 extending vertically therethrough. The row 180 of ventilation windows 184 is forwardly spaced with respect to the row 182 of ventilation windows 186. The ventilation windows 184 are laterally elongate, and extend transversely (or vertically) through the top and bottom ends 174 and 176 of the housing 167, such that windows 184 extending through the top end 174 of the housing are aligned with windows 184 that extend through the bottom end 176 of the housing 167. The ventilation windows 186 are also longitudinally elongate, but are longitudinally spaced farther apart from each other than the windows 184. The windows 186 extend transversely (or vertically) through the top and bottom ends 174 and 176 of the housing 167, such that windows 186 extending through the top end 174 of the housing 167 are aligned with windows 186 that extend through the bottom end 176 of the housing. The housing 124 can further include windows 187 that extend horizontally through the end walls of the housing 167.

Referring also now to FIGS. 10A-D, the housing 167 further retains a plurality of vertical receptacle electrical power contacts 191 arranged into top and bottom rows 196 and 198, respectively. Each power contact 191 can be identically constructed, and includes a main body portion 200, a laterally extending mounting end 202 disposed at one end of the body portion 200 and configured to attach to a substrate, and a mating end 204 disposed at an opposing end of the body portion 200. The mounting ends, or tails, 202 can be provided as solder tails (and can have include a solder ball connected thereto), eye-of-the-needle press-fit pins, or any alternative configuration suitable for attaching to a PCB. In the illustrated embodiment, the mounting ends 202 include four split tails 203, though any number of split tails greater than or equal to one (for instance at least two, at least three, or more than four) are contemplated.

In accordance with one embodiment, the contacts 191 are front end-loaded in the connector housing 167. In other words, in accordance with this embodiment, the contacts 191 are inserted into the front end 170 of the housing 167 in a direction toward the rear end 172. The connector 160 can have a longitudinal dimension anywhere between and including 70 mm and 90 mm, for instance 75 mm, 85 mm, 88 mm, or any alternative desired distance. The lateral, or horizontal, dimension of the connector 160 can be between 10 mm and 25 mm, for instance approximately 15.5 mm. The transverse, or vertical, dimension or height of the connector 160 can be between 5 mm and 12 mm or 6 mm and 8 mm, for instance between approximately 7 mm and approximately 7.5 mm along an imaginary line that passes perpendicular to the slot, through the first row of first power contacts and the second row of second power contacts. Of course, the connectors are not to be construed as limited to these dimensions. It should be further appreciated that electrical contacts can be front end-loaded into a vertical header connector in the manner described herein with respect to the right-angle receptacle connector 160. Vertical connectors or right angle connectors can have a height of 5 mm, 5.1 mm, 5.2 mm, 5.3 mm, 5.4 mm, 5.5 mm, 5.6 mm, 5.7 mm, 5.8 mm, 5.9 mm, 6 mm, 6.1 mm, 6.2 mm, 6.3 mm, 6.4 mm, 6.4 mm, 6.5 mm, 6.6 mm, 6.7 mm, 6.8 mm, 6.9 mm, 7 mm, 7.1 mm, 7.2 mm, 7.3 mm, 7.4 mm, 7.5 mm, 7.6 mm, 7.7 mm, 7.8 mm, 7.9 mm, 8 mm, 8.1 mm, 8.2 mm, 8.3 mm, 8.4 mm, 8.5 mm, 8.6 mm, 8.7 mm, 8.8 mm, and 8.9 mm.

The rows 196 and 198 can be transversely spaced apart parallel to the slot any distance as desired, for instance approximately 1.1 and 2.1 mm, with the distance or gap measured from opposed contact mating surfaces in opposed rows or a distance measured tail to tail across opposed rows. For example, a mating gap may be about 1.1 mm and a tail gap may be about 2.1 mm. Stated another way, the tail gap between rows 196 and 198 of the tails 202 can be on a center-to-center pitch of about 2.7 mm since the power contact thickness is about 0.6 mm. The tails 202 of the electrical contacts 191 of a given row can be spaced apart at any distance as desired, for instance approximately 1.8 mm, with the distance or gap measured from opposed tail surfaces along a common tail centerline that is parallel to a connector receiving slot. Stated another way, the tails 70 can be on a center-to-center pitch of about 2.5 mm.

The mating ends 204 of vertically aligned power contacts 191 are configured to receive an electrical contact therebetween (for instance a blade contact) of a mating electrical device, such as a power PCB card edge, an electrical header connector, or the like. The mating ends 204 include four split blades 206, however any number of split blades greater than or equal to one (for instance at least two, at least three, or more than four) are contemplated. In the illustrated embodiment, the split blades 206 are aligned with the split blades 206 of the lower mating end 204. The split blades 206 of vertically aligned contacts flare transversely away from each other so as to define a contact-receiving space 207 disposed therebetween. The contact-receiving space 207 is configured to receive along the lateral direction an electrical contact therebetween (for instance a blade contact) of a mating electrical device, such as a power PCB card edge, an electrical header contact, or the like. Because the contact receiving space 207 extends parallel with respect to the mounting ends 202, the contacts 191 can be referred to as vertical contacts.

Figure 11B:
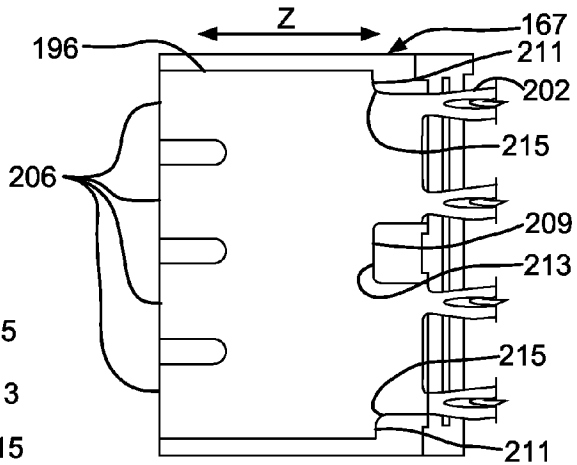
FIGS. 11A-B show quadruple contacts installed in a vertical receptacle connector housing.
Figure 11D:
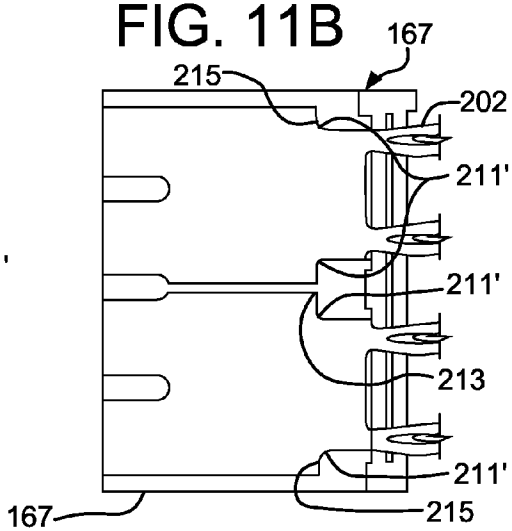
FIGS. 11C-D show twin contacts installed in a vertical receptacle connector housing.
Figure 11A:
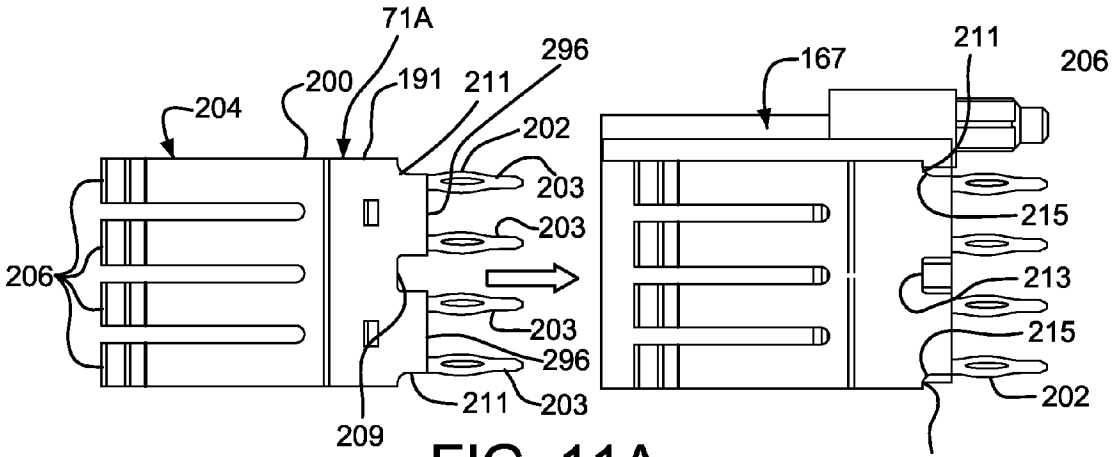

With reference to FIGS. 11A-B, the mounting end 202 of each of the contacts 191 can include a generally rectangular or alternatively shaped alignment pocket 209 that extends into the rear end of the contact 191 at a location between adjacent tails 203. Each contact 191 can further include a pair of L-shaped or alternatively shaped recesses 211 formed in the rear end at the opposing lateral ends of the contact 191. The connector housing 167 can include a complementary generally rectangular alignment projection 213 positioned and sized to fit inside pocket 209 when the contact 191 is installed in the housing 167. The projection 213 engages the pocket 209 so as to restrict relative movement between the contacts 191 into the housing 167 after the contacts 191 have been installed in the housing 167. The housing 167 further includes L-shaped alignment projections 215 positioned and sized to engage the recesses 211 when the contact 196 is installed in the housing 167 to restrict relative movement between the contacts 191 and the housing 167.

Figure 11C:
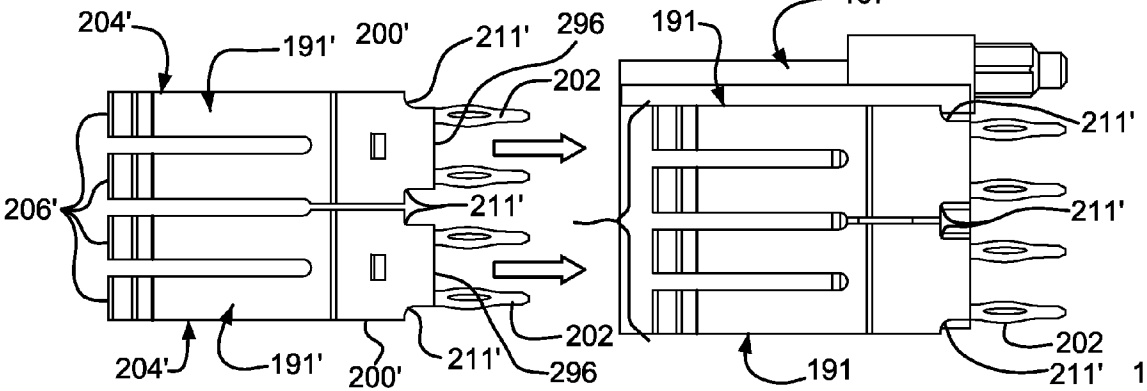

Referring to FIGS. 11C-D, an alternative embodiment shows a pair of contacts 191' constructed generally as described above with respect to the contacts 191, but divided into a pair of laterally separated halves. Thus, each contact 191' a main body portion 200', a laterally extending mounting end 202' disposed at one end of the body portion 200' and configured to attach to a substrate, and a mating end 204' disposed at an opposing end of the body portion 200'. In the illustrated embodiment, the mounting ends 202' include four tails 203', though any number of tails greater than or equal to one (for instance at least two, at least three, or more than four) are contemplated. The mating ends 204' include four split blades 206', however any number of split blades greater than or equal to one (for instance at least two, at least three, or more than four) are contemplated. The first power contacts 191 may have two pairs of contact tails 203', with each of the two pairs of contact tails 203' attached to a corresponding one of two single corresponding buses 296. Two single corresponding busses 296 may be electrically connected to each other by the horizontal panel 71A or may be electrically insulated from one another, as shown in FIG. 11C. The split blades 206' may each extend from the horizontal panel 71A. The contact tails 203' may be evenly spaced apart from one another along a direction parallel to the slot, edge card, or contact receiving space 207 (FIG. 12A).

Alternatively, as illustrated in FIGS. 11C-D, a pair of L-shaped or alternatively shaped recesses 211' can be formed in the rear end of the contacts 191' at the opposing laterally outer ends, for instance when the contact include a pair of tails, and thus has half the lateral dimension as the contact that includes four tails. Accordingly, when the contacts 191' are positioned side-by-side, adjacent recesses 211' combine to form a rectangular pocket approximately sized and shaped as described above with respect to pocket 209, and thus sized and shaped to receive the rectangular projection 213.

Furthermore, the contacts 196 and 198 and the housing 167 include engaging structure that prevents the contacts from being inadvertently removed from front of the housing 167 once that contacts have been installed in the housing.

For instance, referring again to FIGS. 10A-D, each contact 191 includes engagement members 217 in the form of latches 208 that extend transversely outward from the main body portion 200. Thus, the latches 208 of the upper row 196 of contacts 191 project upwardly, and the latches 208 of the lower row 198 of contacts 191 project downwardly. The latches 208 are configured to mate with a complementary engagement members 219 in the form of a catch 210 (see FIG. 12A) formed in the connector housing 167. The latches 208 include one or more barbs 212 that project outward from the body portion 200, and a cam surface 206 that extends toward the body portion 200 along a laterally rearward direction from the barb 212.

Referring now to FIG. 12A, the connector housing 167 can include a catch 210 in the form of rearwardly extending upper and lower arms 216 and 218. The upper arms 216 can extend down through the windows 186 formed in the top end of the connector housing 167, and the lower arms 218 extend up through the windows 186 formed in the bottom end of the connector housing 167. The distal ends of the upper and lower arms 216 and 218 are flexible, and configured to cam over the cam surfaces 206 of the latches 208 as the upper and lower rows 196 and 198, respectively, of contacts 191 are inserted rearward through the front end 170 of the housing 167. The distal ends of the arms 216 and 218 engage the respective barbs 212 once the first power contacts 196 and the second power contacts 198 have been fully installed in the housing 167 in a respective first row and second row, so as to prevent inadvertent removal of the contacts from the housing 167.

Figure 12B:
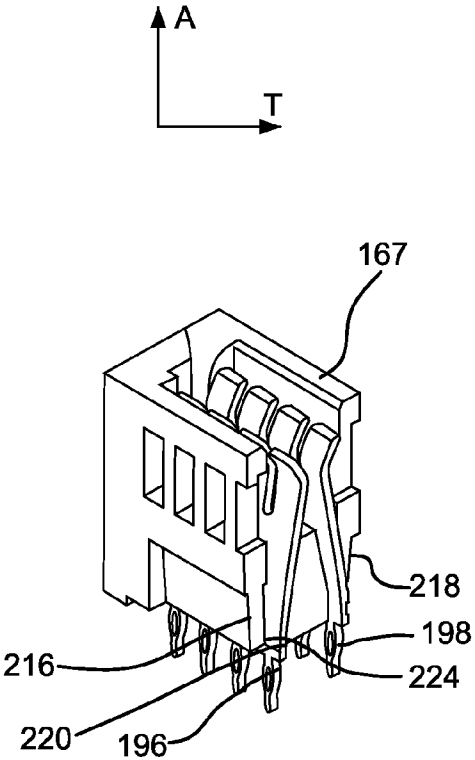
FIGS. 12A-C show electrical contacts being installed in the vertical receptacle housing in accordance with alternative example embodiments.
Figure 12C:
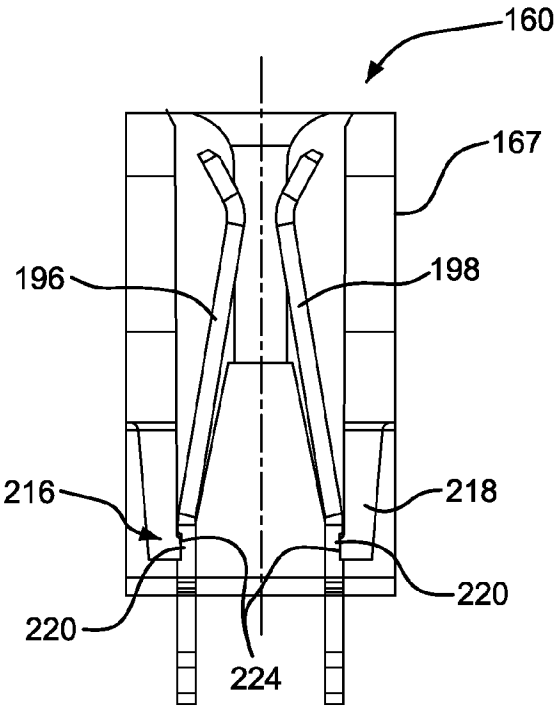
Figure 12A:
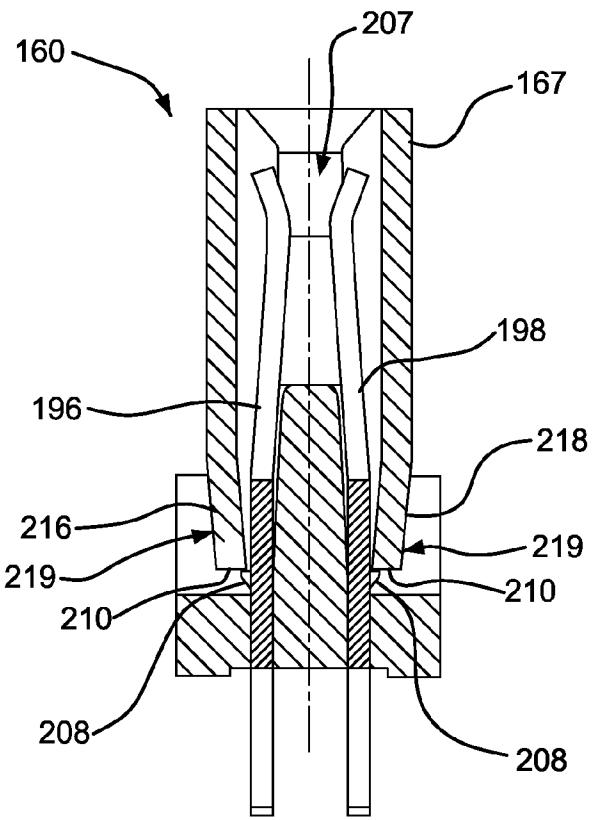
Figure 13B:
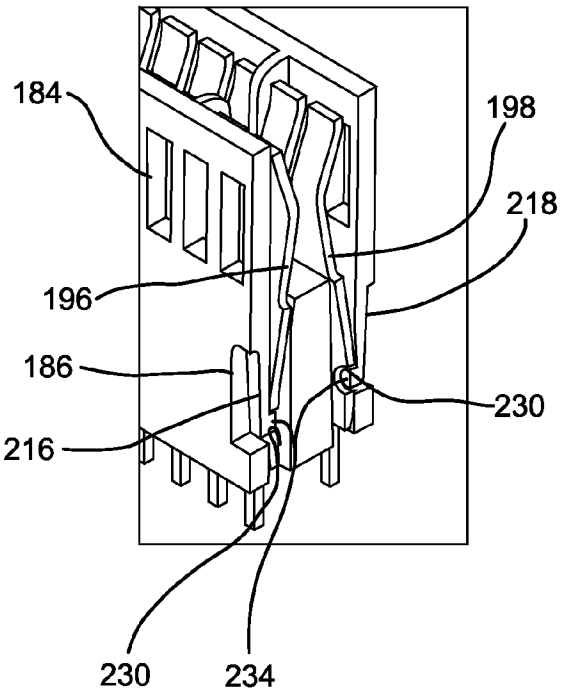
FIGS. 13A-D show a portion of an electrical vertical receptacle connector having retainer features constructed in accordance with another example embodiment.
Figure 13A:
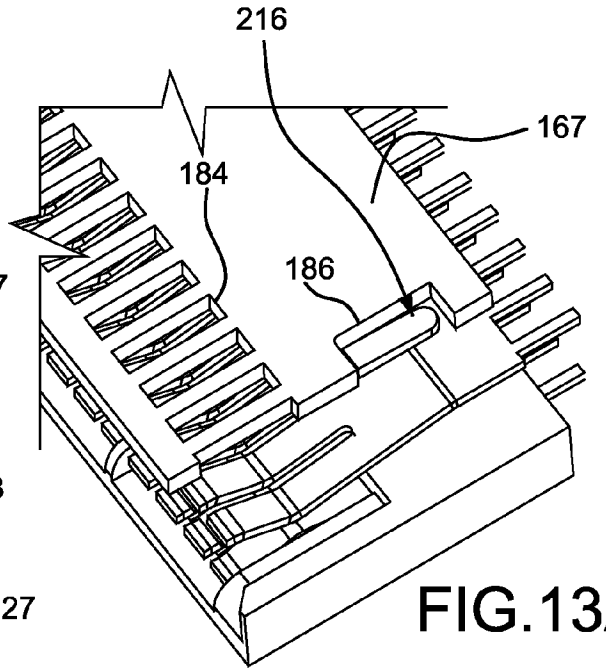
Figure 13C:
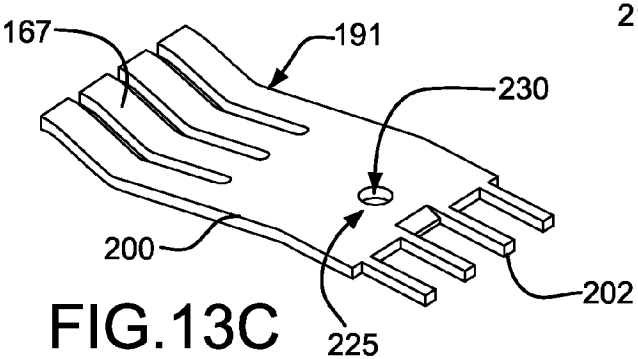
Figure 13D:
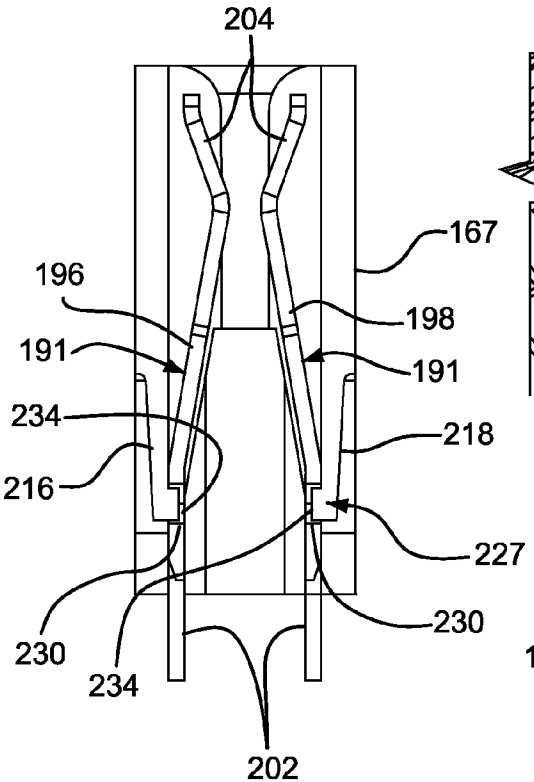
Figure 14A:
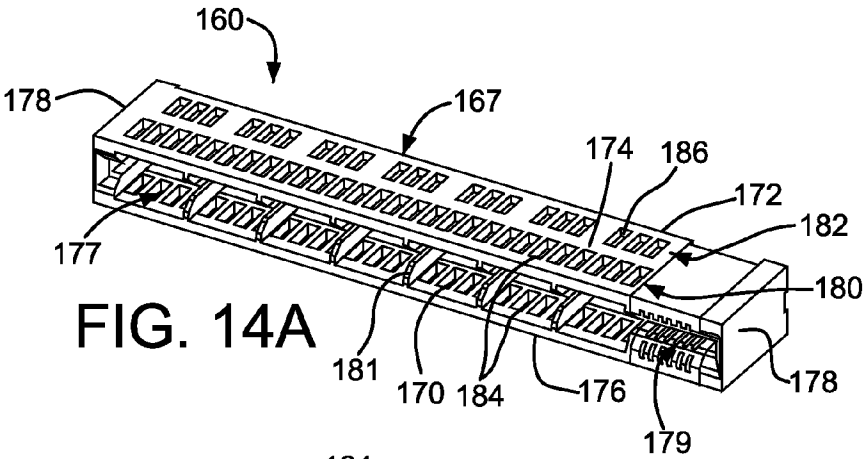
FIGS. 14A-D show various views of a vertical receptacle connector housing constructed in accordance with an example embodiment.
Figure 14D:
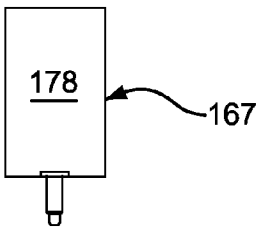
Figure 14B:
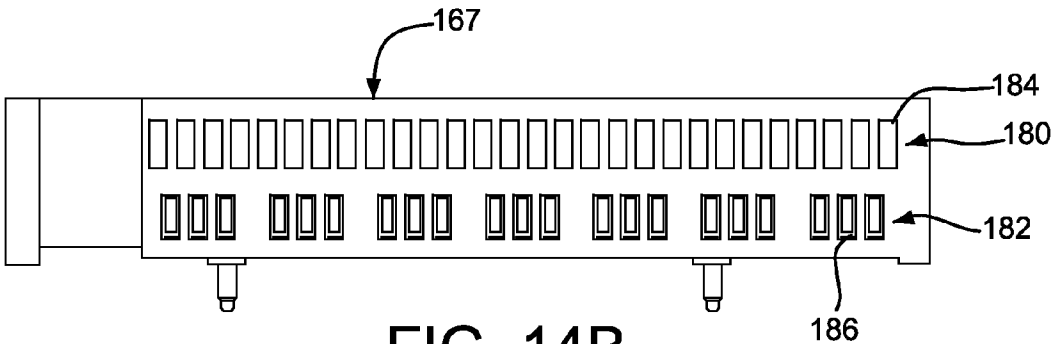
Figure 14C:
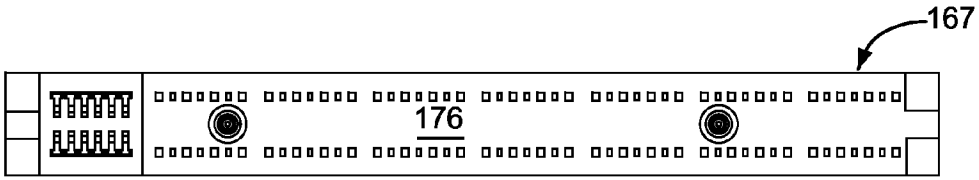

Referring now to FIGS. 12B-C, the first power contacts 196 may include a horizontal panel 71A and a panel engagement member, such as latch 208 or a depression 220, on each respective horizontal panel 71A. The panel engagement member, such as latch 208 or depression 220, engages with a complementary housing engagement member, such as upper and lower arms 216, 218 or ventilation window 186 (FIG. 13B), on the connector housing 167 to retain the first power contacts 196 and the second power contacts 198 with respect to the connector housing 167. Where the housing engagement member is a latch, the complementary housing engagement member is located in a respective ventilation window 186 (FIG. 13B) defined by the connector housing 167. For example, the connector housing 167 can include a latch feature and the contacts 196 and 198 can include a catch feature. In particular, the upper row 196 of contacts can define a depression 220 that extends down and into, or through, the upper surface of the upper contacts 191. Likewise, the lower row 198 of contacts 191 can define a depression 220 that extends down and into, or through, the lower portion of the lower contacts 191.

The upper and lower arms 216 and 218, respectively, of the connector housing 167 can include projections that extend inwardly from the distal ends of the arms 216 and 218. In particular, a projection 224 can extend down from the inner surface of the upper arm 216 at the distal end of the arm 216. Likewise, a projection 224 can extend up from the inner surface of the lower arm 218 and the distal end of the arm 218. The depressions 220 can be sized slightly greater than the projections 224 such that the projections are inserted into the depressions 220 when the contacts 191 are front end-loaded into the connector housing 167.

Referring now to FIGS. 13A-D, the contacts 191 and the housing 167 can define complementary engagement members 225 and 227, respectively, constructed in accordance with an alternative embodiment. In particular, the contacts 191 each include an aperture 230 extending vertically through the contact body 200. The upper and lower arms 216 and 218, respectively, of the connector housing 167 can include projections 234 that extend transversely inward from the distal ends of the arms 216 and 218. In particular, a projection 234 can extend down from the lower surface of the upper arm 216 at the distal end of the arm 216. Likewise, a projection 234 can extend up from the upper surface of the lower arm 218 at the distal end of the arm 218. The apertures 230 can be sized slightly greater than the projections 234 such that the projections are inserted into the apertures 230 when the contacts 191 are installed in the connector housing 167. Alternatively, an aperture can extend through the arms 216 and 218, and a projection can extend from the contacts 196 and 198 that extend into the apertures when the contacts 196 and 198 are installed in the connector housing 167.

It should be appreciated that any of the engagement features described above could be used when installing the electrical power contacts, such as contacts 191, into a connector housing, such as housing 167. In accordance with one method, the contacts 191 can be installed in the housing 167 by loading the contacts into the front end 170 of the housing 167 until the engagement members of the contacts 191 engage the complementary engagement members of the housing 167. The mating ends 204 of the contacts 191 are disposed at the mating end 170 of the connector housing 167 when the engagement members 217 of the contacts 191 mate with the complementary engagement members 219 of the housing 167 to prevent the contacts from being inadvertently removed from the front of the housing once the contacts have been installed.

Referring now also to FIGS. 15A-B, the housing 167 can further retain signal contacts 221 arranged in upper and lower rows 197 and 199, respectively. The signal contacts 221 can be constructed and positioned anywhere along the connector 160 as described above with reference to connector 92 (shown in FIGS. 4A-D). The bottom wall 176 of the connector housing 167 includes a plurality of T-shaped apertures 240 extending along first and second longitudinally extending rows 241 and 243, respectively, that correspond to the upper and lower rows 197 and 199 of contacts 221. The apertures 240 extend vertically through the bottom wall 176 and are configured to receive mounting ends 245 of the signal contacts 197 and 199 such that the corresponding mounting tails 247 extend below the housing 167, and are thus configured to connect to electrical traces of, for instance, a substrate. The apertures 240 are configured to receive the mounting ends of the signal contacts whether the mounting ends are configured as eye-of-the-needle press-fit tails, or vertical signal solder tails. As illustrated, the mounting tails are offset from each other, for instance with respect to the lateral direction.

Referring now to FIGS. 16A-B, the vertical receptacle connector 160 can be connected to an electrical component. The electrical component is a plug contact provided as a card edge 250 of a daughter card, which can be provided as a power card 252. The card edge 250 includes upper electrical plug contacts 254 and lower electrical plug contacts that are aligned with the upper electrical contacts sized and spaced to engage the power contacts of the connector 160. Accordingly, the connector 160 can be devoid of signal contacts 221, such that the power contacts 191 receive the card edge in the contact-receiving space 207 illustrated in FIG. 12A. The upper and lower contacts of the card edge 250 are electrically insulated from each other by a dielectric material 251 disposed between the upper and lower contacts. Thus, it should be appreciated that when the card edge 250 is inserted into the contact-receiving space 207, the power contacts 191 of the upper row 196 and upper contacts 254 are electrically connected to each other in the connector assembly, and the power contacts 191 of the lower row 198 and the lower contacts of the card edge 250 are electrically connected to each other, however the power contacts 191 of the upper row 196 are electrically isolated from the power contacts 191 of the lower row 198. For instance, a direct electrical path through electrically conductive material cannot be established between a contact 191 of the upper row 196 and a contact 191 (or an aligned contact 191) of the lower row 198.

Figure 1B:
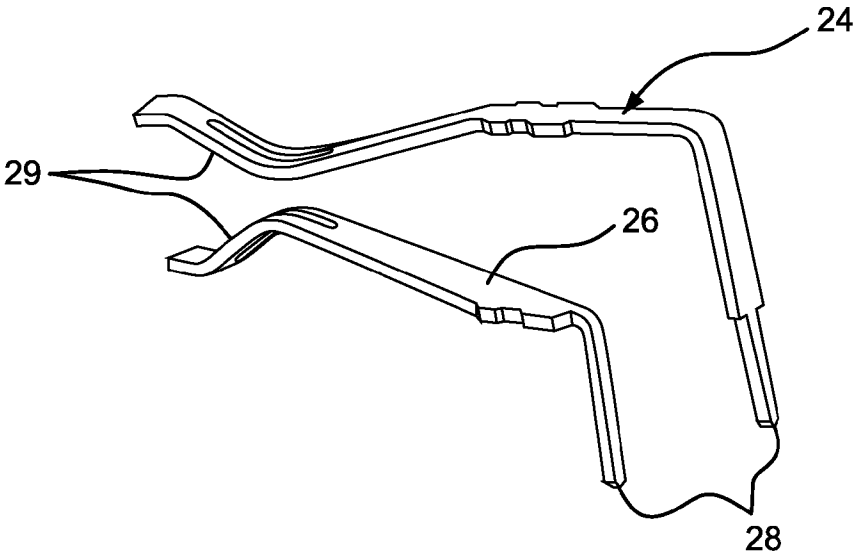
FIG. 1B (Prior Art)
FIG. 1B is a perspective view of the top and bottom contacts of the electrical connector illustrated in FIG. 1A.
Figure 1A:
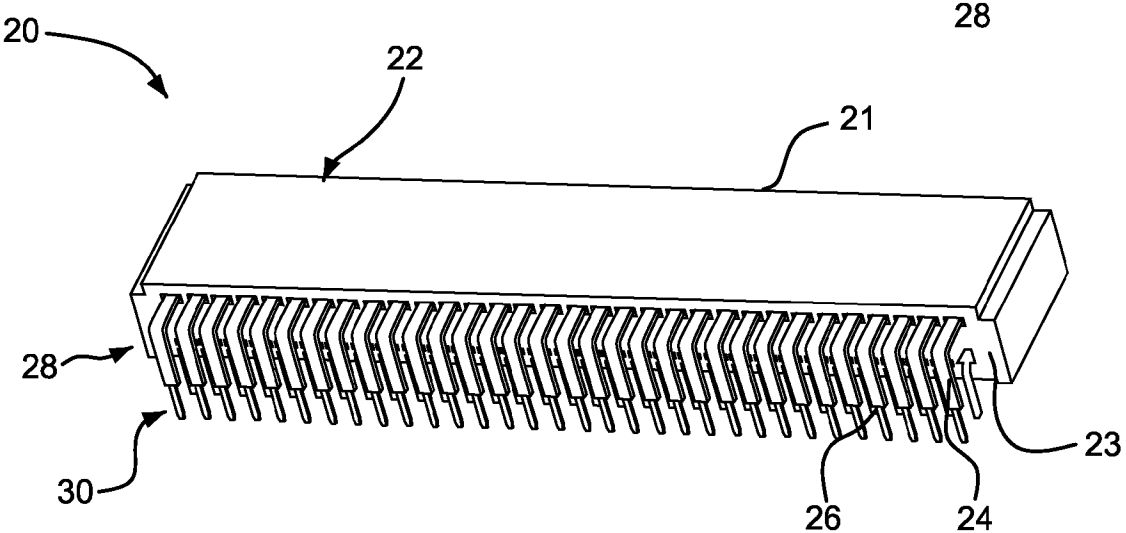
FIG. 1A (Prior Art)
FIG. 1A is a perspective view of a conventional electrical connector including a connector housing and top and bottom contacts disposed in the connector housing.

It has been found that 48 Amps (A) of current can flow through a four-beam power contact of the type illustrated and described herein (e.g., at FIGS. 2B and 1 OD) at a 30 C temperature rise from still air/room temperature, compared to 38 A for four contacts of the type described above with reference to FIGS. 1A-B arranged side-by-side at a temperature rise of 30 C from still air/room temperature. This current flow was determined in a one-row connector having twenty-four power contacts, however it should be appreciated that the amperage is not expected to deviate substantially from the determined amperage as the number of contacts in a given row increases or decreases.

It has further been found that 35 A of current can flow through a four-beam contact of the type illustrated and described herein (e.g., contacts 34, 36 illustrated in FIG. 2B and contacts 191 illustrated in FIG. 10D) at a 30 C temperature rise from still air/room temperature, compared to 29 A for four contacts of the type described above with reference to FIGS. 1A-B at a temperature rise of 30 C from still air/room temperature. This current flow was determined in a two-row connector having forty-eight power contacts (twenty-four power contacts in each row), however it should be appreciated that the amperage is not expected to deviate substantially from the determined amperage as the number of contacts in a given row increases or decreases.

Stated another way, a one row connector having power contacts of the embodiments described herein achieve a current density of about 120 Amps/linear inch, i.e. (48 A/10.16 mm)×(25.4 mm/linear inch)=120 Amps/linear inch (2.54 cm) at a 30 degree Centigrade temperature rise (no air flow). Two rows of power contacts increase the heat, which adversely affects the T-rise. For two rows, the current density is about 180 to 230 Amps/linear inch at a 30 degree C. T-rise. The linear inch extends along the longitudinal direction in the illustrated embodiments. This is an approximate twenty-six percent or 25 Amp improvement over the existing prior art connector shown in FIGS. 1A-B, i.e. (38 A/10.16 mm)×(25.4 mm/linear inch)=95 Amps/linear inch. It should be appreciated that a connector of the type described herein can achieve a current density between and including 96 Amps/linear inch and 140 Amps/linear inch, including 97 Amps/linear inch, 98 Amps/linear inch, 99 Amps/linear inch, 100 Amps/linear inch, 101 Amps/linear inch, and any level up to an including 140 Amps/linear inch, including 130 Amps/linear inch, 135 Amps/linear inch, 136 Amps/linear inch, 137 Amps/linear inch, 138 Amps/linear inch, and 139 Amps/linear inch.

The increased current density achieved by the receptacle power contacts of the type described herein is provided in a low-profile connector housing, such as housings 32, 114, and 167, which allows the power contacts to provide a higher current density without an increase in the real estate occupied by the housing on the printed circuit board, and also without an increase in the card pitch. In some embodiments, the connector housing is smaller than conventional connector housings while the connector has a greater contact density than conventional power connectors. For instance, the electrical contacts can have a thickness of 0.6 mm as describe above.

It should be appreciated that a method of operating an electrical power connector assembly, such as assembly 137 and assembly 162, and in particular an electrical power receptacle connector of the assembly, can include the step of providing the power receptacle connector, attaching the mounting tails of the power contacts of the power receptacle connector to a substrate, such as a printed circuit board, receiving a plug contact of a header connector, such as header connector 112, or of a card edge such as card edge 250, in the contact-receiving space defined by electrically isolated upper and lower power receptacle contacts, and driving electrical current through the power contacts of the receptacle connector at a current density of about 120 Amps/linear inch.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Furthermore, it should be appreciated that structures ad features described above in connection with one or more embodiments can be included in all other embodiments, unless otherwise indicated. Those skilled in the relevant art, having the benefit of the teachings of this specification, may effect numerous modifications to the invention as described herein, and changes may be made without departing from the scope and spirit of the invention as defined by the appended claims.

What is claimed:

1. An electrical power connector comprising:

a connector housing having a front end that defines a mating interface, wherein the mating interface further defines a slot;

a first row of first power contacts supported by the housing, the first power contacts each defining a first mating end and an opposing first mounting end; and a second row of second power contacts supported by the housing at a location spaced from the first row of power contacts, the second power contacts each defining a second mating end and an opposing second mounting end;

wherein each of the first power contacts comprises a horizontal panel and a panel engagement member on each respective horizontal panel, the panel engagement member engages a complementary housing engagement member on the connector housing to retain the first power contacts with respect to the connector housing, and each complementary housing engagement member is located in a respective ventilation window defined by the connector housing.

2. The electrical power connector as recited in claim 1, wherein the electrical power connector has a current density of 120 A per 2.54 linear centimeters along the first row of power contacts.

3. The electrical power connector as recited in claim 1, wherein the complementary housing engagement member comprises a latch.

4. The electrical power connector as recited in claim 1, wherein the panel engagement member comprises a latch.

5. The electrical power connector as recited in claim 1, wherein the first row of first power contacts and the second row of second power contacts are spaced approximately 1.1 mm to 2.4 mm from each other.

6. The electrical power connector as recited in claim 1, wherein the first and second power contacts are vertical contacts, and the connector housing defines a height between approximately 6 mm and 8 mm.

7. An electrical power connector comprising:

a connector housing having a front end that defines a mating interface, wherein the mating interface further defines a slot;

a first row of first power contacts supported by the housing, the first power contacts each defining a first mating end and an opposing first mounting end; and a second row of second power contacts disposed supported by the housing at a location spaced from the first row of power contacts, the second power contacts each defining a second mating end and an opposing second mounting end;

wherein the first power contacts have two pairs of contact tails, each of the two pairs of contact tails are attached to a corresponding one of two single corresponding buses, the two single corresponding busses are electrically connected to each other by a horizontal panel, the connector housing defines a height between approximately 6 mm and 8 mm, and the electrical power connector has a current density of 180 A to 230 A per 2.54 linear centimeters along the two rows of power contacts.

8. The electrical connector as claimed in claim 7, wherein the first power contacts further comprise a plurality of split blades that each extend from the horizontal panel.

9. The electrical connector as claimed in claim 7, wherein the two pairs of contact tails are evenly spaced apart from one another along a direction parallel to the slot.

10. The electrical connector as claimed in claim 7 wherein the electrical power connector has a current density of 120 A per 2.54 linear centimeters along the first row of first power contacts.

11. An electrical power connector comprising:

a connector housing having a front end that defines a mating interface, wherein the mating interface further defines a slot;

a first row of first power contacts supported by the housing, the first power contacts each defining a first mating end and an opposing first mounting end; and a second row of second power contacts disposed supported by the housing at a location spaced from the first row of power contacts, the second power contacts each defining a second mating end and an opposing second mounting end;

wherein the first power contacts have only two contact tails, each of the two contact tails are attached to a corresponding one of two single corresponding buses, the two single corresponding busses are electrically isolated from one another, the connector housing defines a height of approximately 6 mm and 8 mm, and the electrical power connector has a current density between and including 96 A and 140 A per 2.54 linear centimeters along the first row of first power contacts.

12. The electrical power connector as claimed in claim 11, wherein the first power contacts further comprise a plurality of split blades that each extend from a respective horizontal panel of the first power contacts.

13. The electrical power connector as claimed in claim 11, wherein the two pairs of contact tails are evenly spaced apart from one another along a direction parallel to the slot.

14. The electrical power connector as claimed in claim 11 wherein the electrical power connector has a current density of 120 A per 2.54 linear centimeters along the first row of first power contacts.

15. An electrical power connector comprising:

a connector housing having a front end that defines a mating interface, wherein the mating interface further defines a slot;

a first row of first power contacts supported by the housing, the first power contacts each defining a first mating end and an opposing first mounting end; and a second row of second power contacts disposed supported by the housing at a location spaced from the first row of power contacts, the second power contacts each defining a second mating end and an opposing second mounting end;

wherein the connector housing defines a height between approximately 6 mm and approximately 8 mm and the electrical power connector has a current density of 120 A per 2.54 linear centimeters at a thirty degree centigrade temperature rise along the first row of power contacts.

16. The electrical power connector as recited in claim 1, wherein the connector housing further comprises a polarization wall that extends between upper and lower ends of the connector housing, the polarization wall configured to be received in a complementary slot of a complementary electrical connector that is to be mated in a desired orientation.

17. The electrical power connector as recited in claim 16, further comprising a plurality of signal contacts supported by the connector housing at a location adjacent the first and second rows of power contacts, wherein the polarization member is disposed between the signal contacts and the first and second rows of power contacts.

18. The electrical power connector as recited in claim 16, wherein the first power contacts are spaced along a longitudinal direction and the second power contacts are spaced along the longitudinal direction, and the polarization wall is disposed at a location offset with respect to a longitudinal center of the connector housing.

19. The electrical power connector as recited in claim 1, further comprising a plurality of signal contacts supported by the connector housing at a location adjacent the first and second rows of power contacts.

20. The electrical power connector as recited in claim 7, further comprising a plurality of signal contacts supported by the connector housing at a location adjacent the first and second rows of power contacts.

21. The electrical power connector as recited in claim 7, wherein the connector housing further comprises a polarization wall that extends between upper and lower ends of the connector housing, the polarization wall configured to be received in a complementary slot of a complementary electrical connector that is to be mated in a desired orientation.

22. The electrical power connector as recited in claim 11, further comprising a plurality of signal contacts supported by the connector housing at a location adjacent the first and second rows of power contacts.

23. The electrical power connector as recited in claim 11, wherein the connector housing further comprises a polarization wall that extends between upper and lower ends of the connector housing, the polarization wall configured to be received in a complementary slot of a complementary electrical connector that is to be mated in a desired orientation.

24. The electrical power connector as recited in claim 15, further comprising a plurality of signal contacts supported by the connector housing at a location adjacent the first and second rows of power contacts.

25. The electrical power connector as recited in claim 15, wherein the connector housing further comprises a polarization wall that extends between upper and lower ends of the connector housing, the polarization wall configured to be received in a complementary slot of a complementary electrical connector that is to be mated in a desired orientation.

26. An electrical power connector comprising:

a connector housing having a front end that defines a mating interface, wherein the mating interface further defines a slot;

a first row of first power contacts supported by the housing, the first power contacts each defining a first mating end and an opposing first mounting end; and a second row of second power contacts disposed supported by the housing at a location spaced from the first row of power contacts, the second power contacts each defining a second mating end and an opposing second mounting end;

wherein the connector housing defines a height between approximately 6 mm and approximately 8 mm, and the electrical power connector has a current density of 180 A to 230 A per 2.54 linear centimeters at a thirty degree centigrade temperature rise along the two rows of power contacts.

27. The electrical power connector as recited in claim 26, wherein the connector housing further comprises a polarization wall that extends between upper and lower ends of the connector housing, the polarization wall configured to be received in a complementary slot of a complementary electrical connector that is to be mated in a desired orientation.

28. The electrical power connector as recited in claim 27, further comprising a plurality of signal contacts supported by the connector housing at a location adjacent the first and second rows of power contacts, wherein the polarization member is disposed between the signal contacts and the first and second rows of power contacts.

29. The electrical power connector as recited in claim 26, wherein the first power contacts are spaced along a longitudinal direction and the second power contacts are spaced along the longitudinal direction, and the polarization wall is disposed at a location offset with respect to a longitudinal center of the connector housing.

30. The electrical power connector as recited in claim 26, further comprising a plurality of signal contacts supported by the connector housing at a location adjacent the first and second rows of power contacts.

* * * * *